US006895211B2

(12) United States Patent
Yamashita et al.

(10) Patent No.: US 6,895,211 B2
(45) Date of Patent: May 17, 2005

(54) ELECTROPHOTOGRAPHIC APPARATUS

(75) Inventors: Taichiro Yamashita, Tsuchiura (JP); Toru Miyasaka, Tsuchiura (JP); Masahiro Yagi, Kashiwa (JP); Shintaro Yamada, Chiyoda (JP); Kenji Asuwa, Toride (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/730,112

(22) Filed: Dec. 9, 2003

(65) Prior Publication Data

US 2005/0025544 A1 Feb. 3, 2005

(30) Foreign Application Priority Data

Jul. 31, 2003 (JP) ..... 2003-204997

(51) Int. Cl.[7] ..... G03G 15/00

(52) U.S. Cl. ..... 399/400; 399/401; 399/397; 399/388

(58) Field of Search ..... 399/364, 388, 399/397, 400, 401

(56) References Cited

U.S. PATENT DOCUMENTS

| | | | | |
|---|---|---|---|---|
| 5,839,016 | A | * 11/1998 | Folkins et al. | 399/46 |
| 6,041,213 | A | * 3/2000 | Yanagi | 399/401 |
| 6,055,410 | A | * 4/2000 | Marumoto et al. | 399/392 |
| 6,185,380 | B1 | * 2/2001 | Abe et al. | 399/18 |
| 6,215,970 | B1 | * 4/2001 | Yoshikawa et al. | 399/124 |
| 6,522,861 | B2 | * 2/2003 | Tokutake et al. | 399/401 |
| 6,615,018 | B2 | * 9/2003 | Funato | 399/322 |
| 6,798,430 | B2 | * 9/2004 | Sato | 347/115 |
| 6,801,749 | B2 | * 10/2004 | Yasui et al. | 399/401 |

FOREIGN PATENT DOCUMENTS

| | | |
|---|---|---|
| JP | A-6-208266 | 7/1994 |
| JP | A-8-137179 | 5/1996 |
| JP | A-2001-2330 | 1/2001 |
| JP | A-2001-356548 | 12/2001 |

* cited by examiner

*Primary Examiner*—Andrew H. Hirshfeld
*Assistant Examiner*—Dave A. Ghatt
(74) *Attorney, Agent, or Firm*—Antonelli, Terry, Stout & Kraus, LLP

(57) ABSTRACT

Provided is a small-sized electrophotographic apparatus having a double face printing function, which can print at a high speed even during double face printing. There are provided a recording medium conveying path 5 composed of a vertical conveying path 5*a* for upward conveying a sheet fed from a sheet cassette 2, outside of a developing means 60, a curved conveying path 5*b* and horizontal conveying path 5*c* for conveying the recording medium to a transfer means 50, a fusing means 51 located in the horizontal conveying path 5*c*, downstream of the transfer means 50, for fusing a toner image on the recording medium 2, a sheet discharge tray 53, a bypass conveying path for guiding a sheet to be subjected to double face printing, having one surface for which printing has been completed, a first branch means 58 for guiding the sheet to be subjected to double face printing from a conveying path for the sheet discharge tray 53 into the bypass conveying path 56, a reversing conveying path 54 for reversing the sheet conveyed in the bypass conveying path 54 during double face printing, a second branch means 59 for guiding the sheet which has been reversed in the reversing conveying path 54, into the horizontal conveying path 5*c*, and a return conveying path 57 for returning the sheet which has passed through the second branch means 59, into the return conveying path 57 for conveying the sheet to the horizontal conveying path.

13 Claims, 16 Drawing Sheets

ELECTROPHOTOGRAPHIC APPARATUS

BACKGROUND OF THE INVENTION

The present invention relates to an image forming apparatus such as a copying machine, a printer, a facsimile system which forms a color image with the use of electrophotography, and in particular, to an electrophotographic apparatus for forming a color image with the use of a plurality of color toners.

With the electrophotography, a light beam is projected from an exposure means onto a photoconductive medium which is uniformly charged, so as to form a latent image corresponding to image data, and toner is stuck to the latent image on the photoconductive medium so as to develop the latent image. The thus obtained toner image is transferred onto and fixed on a recording medium.

It is noted here that explanation will be hereinbelow made so as to use the recording medium as a sheet. However, the recording medium should not be limited to the sheet alone but there may be used a sheet-like recording medium made of any of various materials including plastic.

In order to form a color image, a plurality of color toners such as yellow Y, magenta M, cyan C and black K are superposed one upon another so as to form the image.

There are two kinds of color image forming systems, such as a repeated developing system in which development is repeated on a single photoconductive medium with color toners so as to form a color image, and a simultaneous developing system in which developments are simultaneously carried out on a plurality of photoconductive mediums with color toners so as to form a color image.

The repeated development system is the one in which a single photoconductive medium is used for forming a color image, and as a typical example, there an intermediate transfer medium system.

In the intermediate transfer medium system, a plurality of developing means for developing images with different color toners are arranged around a photoconductive medium, together with an intermediate transfer medium, and toner color images formed on the photoconductive medium are transferred one by one onto the intermediate transfer medium (Refer to, for example, JP-A-8-137179). This transfer is repeated for different color images so as to superpose these images on the intermediate transfer medium in order to form a color image which is then transferred onto a medium on which the color image is fixed.

In the intermediate transfer medium system, since different toner color images of, for example, yellow Y, magenta M, cyan C and black K are formed one by one on the photoconductive medium, and are then transferred onto the intermediate transfer medium, being superposed one upon each other, a time which is four times as long as that required for formation of a monochromatic image is required.

The simultaneous developing system simultaneously forms color toner images respectively on a plurality of photoconductive mediums for respective different colors, and transfers the different color toner images in association with a conveyance of a sheet so as to form a color image. Thus, this developing system is also called as a tandem system. (Refer to, for example, JP-A-2001-356548).

The tandem system incorporates an image forming means including a photoconductive medium, a charging means, an exposure means, a developing means and a cleaner means, independently, for each color, and accordingly, four image forming means are required for forming a color image with color toners of yellow Y, magenta M, cyan C and black K.

In the tandem system, different toner color images are formed by four independent image forming means, simultaneously in parallel with one another, and are then transferred onto an intermediate transfer medium or a sheet. In the tandem system, since different toner color images are simultaneously superposed one upon another, a color image can be formed by a time nearly equal to that required for formation of a monochromatic image, and accordingly, this system is preferable for high speed printing of a color image.

These years, there have been increased demands for colorization of documents in offices and accordingly, color printers have been rapidly spread in use. Further, it has been desired to increase the printing speed, and accordingly, tandem system color printers have been spot-lighted.

However, since the tandem system color printer inevitably incorporates four image forming means, the miniaturization of the printer is difficult, that is, it has a size which is relatively larger than that of a repeated development system color printer.

In order to make the apparatus small-sized, there may be utilized either a manner in which the height of the apparatus is decreased so as to flatten the apparatus or a manner in which the floor area of the apparatus is decreased so as to have a vertical type having an increased height. In the case of installation of a printer in an office or a home, the restraint to the height thereof is relatively less, and accordingly, configuration having an increased height but a decreased floor area is desirable if the bulk of the printer is fixed.

Further, these years, in order to save paper resource, a double face printing function for printing opposite surfaces of a paper sheet has been desired, and accordingly, it is required to make the apparatus small-sized while incorporating a double face printing function.

In case of the color printer of the repeated development system, four color toner images of yellow, magenta, cyan and black which are to be printed on the backside of a paper sheet, are formed one by one on a photoconductive medium, and are then superposed on an intermediate transfer medium, and accordingly, there is a time for reversing the sheet for the preparation of transferring the images onto the backside of the sheet. Thus, no difference is appreciated in printing speed between single face printing and double face printing.

On the contrary, in the case of the color printer of the tandem system, when images are printed successively on one side of a paper sheet, they are successively printed on the paper sheet one by one with a space of about, for example, 50 mm therebetween.

However, in the case of double face printing, a sheet on which single face printing has been completed is reversed while a conveying direction is reversed so that the tailing end of the sheet is turned into the leading end, and the sheet whose advancing direction is reversed is inserted in a conveying path upstream of a transfer means in order to transfer a full color image which is formed on the intermediate transfer medium, onto the backside of the sheet. Thereafter, the full color image is fixed. Thus, since the toner image cannot be transferred onto the sheet when the sheet is reversed, the printing speed per minute of the double face printing is lower than that of the single face printing.

Accordingly, it has been desired to increase the printing speed of the double face printing so as to approach the printing speed of the single face printing as possible as it can.

There has been known an electrophotographic apparatus which can form an image while a sheet is conveyed in a substantially vertical direction during double face printing (Refer to, for example, JP-A-2001-002330).

In this photographic apparatus, there are provided, in an openable door, a sheet conveying means for downward conveying sheet in a substantially vertical direction while transferring toner images onto the sheet along a plurality of image forming means, a sheet reversing and conveying means as a reversing means for reversing the sheet to be subjected to double face printing so that the leading end of the sheet is turned into the trailing end thereof, a guide portion for reversing the advancing direction of the sheet fed upward from the reversing and conveying path by an angle of about 180 deg., so as to downward direct the same, a sheet refeeding means for conveying the sheet from the curved guide portion to a position which is off from a pair of registering rollers to a sheet cassette.

In this electrophotographic apparatus, the fusing means is arranged above the image forming means, that is, it is located in the uppermost part of the apparatus.

Meanwhile, the registering rollers at a stating point of the image forming portion for transferring images onto a sheet, are located in the lowermost part of the conveying path, near the sheet cassette.

In order to print the backside surface of a sheet for which the transfer and fusing of the image has been completed on the front side thereof, the sheet is inserted downward into the reversing and conveying path so that the traveling direction of the sheet is reversed, and accordingly, the end of the sheet which has been the trailing end until then is turned into the leading end thereof. Thus, the images are transferred onto the sheet after the sheet is merged into the conveying path upstream of the registering rollers.

Further, there has been known an electrophotographic apparatus incorporating a main conveying path and a bypass conveying path, a recording medium is reversed through the bypass conveying path, and is returned into the main conveying path through which the recording medium is again conveyed with its backside surface facing to the imaging forming portion (Refer to, for example, JP-A-6-208266).

In the electrographic apparatus disclosed in JP-A-2001-2330, the return conveying path for returning a sheet fed from the reversing conveying path for registering rollers is provided semicircular guide portions at its top and bottom since the sheet fed out upward has to be turned by an angle of about 180 deg. so as to be conveyed downward to a position in the vicinity of the lower end of the apparatus, and then has to be turned by an angle of about 180 deg, so as to be conveyed upward before it is merged into the conveying path upstream of the registering rollers.

Should the radius of each of these curved part portions be decreased to a small value, it would be likely to cause jamming of a sheet, and accordingly, it cannot be sufficiently decreased, that is its possible minimum diameter should be about 50 mm.

Thus, the thickness of the opening door has to be about 70 mm at minimum since there is required a space for mounting conveying rollers to the reversing conveying path and the sheet refeeding means, in addition to the diameters of the curved guide portions, thereby there has been a limitation to miniaturization of the electrophotographic apparatus.

Further, in this conventional technology, the opening door portion is provided therein with a sheet conveying means, a sheet refeeding means and, a seat reversing means which are stacked in three layers, and accordingly, the thickness of the opening door becomes larger.

In the electrophotographic apparatus as disclosed in JP-A-6-208266, in the case of printing the backside surface of a sheet, since no extra space corresponding to a reversing conveying path which temporarily stores therein a sheet, is required, the configuration thereof is appropriate for miniaturization.

However, in order to carry out double face printing, since a sheet is conveyed through the main conveying path in a reverse direction, a printing sheet as a next page cannot be soon fed until the reversal is completed, there is a limitation to increasing of a printing speed of double face printing.

BRIEF SUMMARY OF THE INVENTION

Accordingly, an object of the present invention is to provide an electrophotographic apparatus incorporating a double facing printing function, which can print at a high printing speed even during double face printing.

To the end, according to the present invention, there is provided an electrophotographic apparatus comprising a plurality of image forming means each including a photoconductive drum having a photoconductive layer, an exposure means for forming an electrostatic latent image on the photoconductive layer of the photoconductive drum, and a developing means for causing toner to stick to the latent image on the photoconductive drum so as to form a toner image, an endless intermediate transfer belt rotated around and stretched between a drive roller and a driven roller, a transfer means located above a row of the photoconductive drums, for transferring a toner image from the intermediate transfer belt onto a recording medium, toner images formed on the plurality of photoconductive drums being transferred onto the recording medium through the intermediary of the intermediate transfer belt so as to form a color image thereon, a recording medium supply path composed of a vertical conveying path for upward conveying a recording medium fed from a sheet cassette in which recording mediums are accommodated, outside of the developing means, a curved conveying path, a horizontal conveying path for conveying the recording medium, in a substantially horizontal direction, to the transfer means, a fusing means located on the horizontal conveying path, downstream of the transfer means, for fusing the transferred toner image on the recording medium, a discharge tray for stacking therein recording mediums for which printing is completed, and which are discharged, a bypass conveying path for conveying a recording medium to be subjected to double face printing, for which printing has been made on one side surface thereof, a first branch means for guiding the recording medium to be subjected to double face printing double face printing from the conveying path for the discharge tray, onto the bypass conveying path, a reversing conveying path for reversing the recording medium conveyed on the bypass conveying path during double face printing, a second branching means for guiding the recording medium reversed in the reversing conveying path from the bypass conveying path onto the horizontal conveying path during double face printing, and a return conveying path for conveying the recording medium which has passed through the second branch means onto the horizontal conveying path.

Only the vertical conveying path and the reversing conveying path are laid in substantially parallel with each other in an opening door at the front surface of the electrophotographic apparatus.

Conveying rollers for driving a recording medium which is inserted into the reversing conveying path and is then fed out, are provided on the body side of the electrophotographic apparatus so as to define the reversing conveying path as a mere hollow space, thereby it is possible to allow the structure of the opening door to be simple and thin.

The opening door may have a mechanism for opening the door along the vertical conveying path in order to carry out maintenance such as disposal of a jam of recording mediums.

It is convenient to provide a casing upper part which is opened along the curved conveying path and the horizontal conveying path, in order to carry out maintenance such as replacement of components or disposal of a jam of recording medium.

Further, the provision of a mechanism for opening the casing upper part along the bypass conveying path facilitates maintenance in the casing upper part.

The provision of a manual feed tray on a substantial extension of the return conveying path enables recording of data on a specialty paper sheet such as a cardboard.

It is desirable to satisfy the following relationships:

$$L1>(2\times P\text{max}+\text{Gap})$$

$$L2>\text{Pmax}$$

where L1 is a length of the looping route which comes out from and returns to the second branch means on the bypass path, by way of the second transfer means on the horizontal path, the fusing means, the first branch means and the bypass path, L2 is a length of the reversing conveying path which extends from the second branch means to a position in the vicinity of the sheet cassette, Pmax is a maximum length of a recording medium, and Gap is a gap between recording mediums to be conveyed.

In this case, the return conveying path from the second branch means is formed in an S-like shape in order to ensure a required length for the return conveying path.

It is possible to satisfy the following relationships:

$$L1<(2\times P\text{max}+\text{Gap})$$

$$L2>\text{Pmax}$$

where L1 is a length of the looping route which comes out from and returns to the second branch means on the bypass path, by way of the second transfer means on the horizontal path, the fusing means, the first branch means and the bypass path, L2 is a length of the reversing conveying path which extends from the second branch means to a position in the vicinity of the sheet cassette, Pmax is a maximum length of a recording medium, and Gap is a gap between recording mediums to be conveyed.

In this case, recording sheets fore and aft pass by each other, being overlapped each other during double face printing.

The second branch means may incorporate a stepped part for guiding the leading end of a recording medium fed from the reversing conveying path onto the return conveying path.

The second branch means may incorporate a branch assist member for guiding the leading end of a recording medium fed out from the reversing conveying path onto the return conveying path, which is lifted by the recording medium when the recording medium is fed from the bypass conveying path onto reversing conveying path, but naturally drops under gravity when the recoding medium is fed from the reversing conveying path onto the return conveying path.

There is provided a recording medium detecting means for detecting the presence of a recording medium on the conveying path from the second branch means to the reversing conveying path so as to determine an operation timing of a recording medium driving mechanism associated with the reversing conveying path.

Other objects, features and advantages of the invention will become apparent from the following description of the embodiments of the invention taken in conjunction with the accompanying drawings.

DETAILED DESCRIPTION OF THE INVENTION

Figure 1:
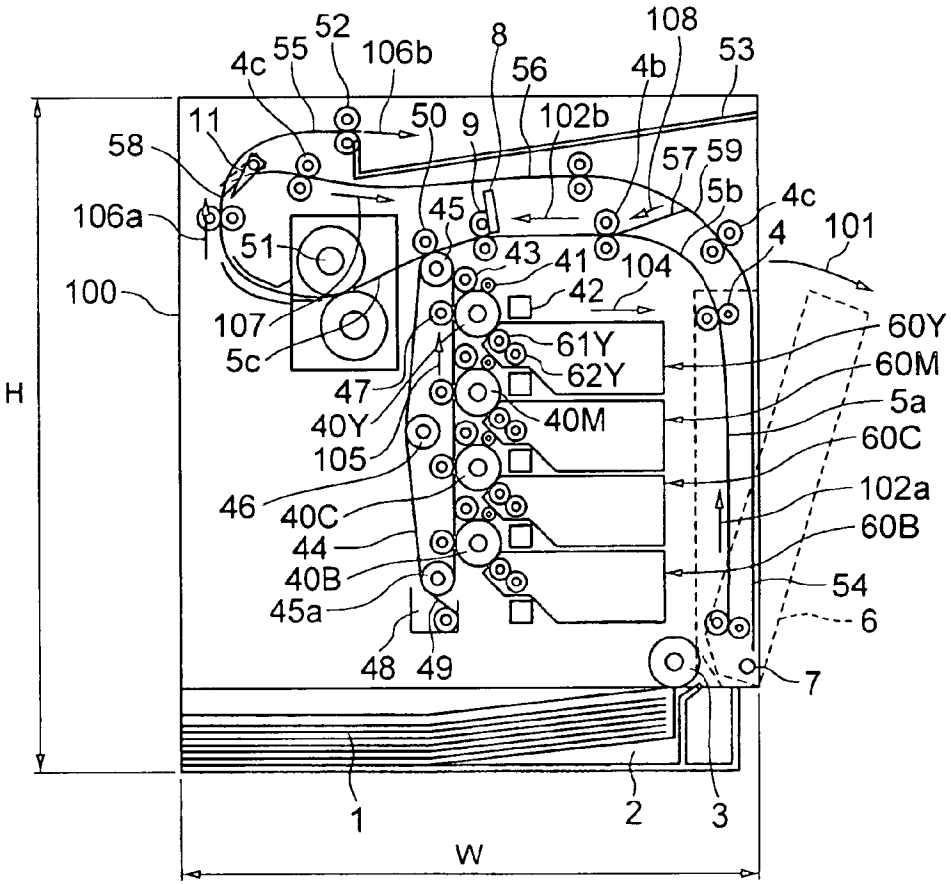
FIG. 1 is a sectional view illustrating an overall configuration of an embodiment 1 of an electrophotographic apparatus incorporating a double face printing function according to the present invention.

FIG. 1 shows an overall configuration of an embodiment 1 of an electrophotographic apparatus incorporating a double face printing function according to the present invention.

The electrophotographic apparatus in the embodiment 1 is composed of a casing 100, a sheet cassette 2, a sheet separating means 3, a conveying means 4, a sheet conveying path 5, an opening door 6, a sheet position detecting means 8, a registering roller 9, four image forming means 70 for yellow Y, magenta M, cyan C and black K, an intermediate transfer belt 44, a drive roller 45, a driven roller 45*a*, a tension regulating roller 46, a transfer cleaning means 48, a second transfer means 50, a fusing means 51, a pair of sheet discharge rollers 52 and a sheet discharge tray 53.

The sheet cassette 2 is located in the bottom part of the casing 100 so as to be drawable in the front of the electrophotographic apparatus, in order to accommodate therein sheets 1. The sheet separating means 3 is incorporated in the front end part of the sheet cassette 2 which is near the opening door 6, for separating the sheets set in the sheet cassette 2, one by one.

The conveying means 4 is composed of rubber rollers and the like, for conveying sheets 1 separated one by one in a direction of an arrow 102 along the conveying path 5 incorporating a sheet conveying guide at a predetermined speed, and is extended from a contact point between the sheet separating means 3 and the sheet cassette 2 as a start point, to the discharge roller 52 by way of the drive roller 45 and the second transfer roller 50. That is, the sheet conveying path 5 is composed of a vertical conveying path 5*a* for conveying the sheet 1 upward, a curved conveying path 5*b* which is moderately curved, for directing the sheet 1 toward the second transfer means 50, and a horizontal conveying path 5*c* for conveying the sheet 1 whose conveying direction has been changed in a horizontal direction.

The opening door 6 which is located in the front of the casing 100, is opened around a rotating fulcrum 7 in the direction of the arrow 101.

The sheet position detecting means 8 is located on the conveying path 5 on the upstream side of the registration rollers 9, for detecting a position of a sheet. The sheet position detecting means 8 may be one of a reflected light detecting type for detecting a variation in volume of light reflected from the surface of a sheet 1, a transmitted light detection type for detecting a variation in volume of received light when a sheet 1 passes between a light emitting element and a light receiving element, a lever detecting type for detecting a contact between a lever and a leading end of a sheet, and the sheet position detecting means 8 detects a leading end of a sheet which has comes to the sheet position detecting means 8 so as to deliver a sheet position signal. The pair of the registering rollers 9 is located in the horizontal conveying path 5*c* on the side near the curved conveying path 5*b* of the second transfer means 50, adjacent to the second transfer means 50.

The image forming means 70 for yellow Y, magenta M, cyan C and black K, are stacked one upon another in the mentioned order along the intermediate transfer belt 44 on the side near the front opening door 6.

The endless intermediate transfer belt 44 is stretched in a loop-like manner between the drive roller 45 and a idle roller 45*a*. The drive roller 45 is located in the center upper part of the casing 100, having its axis in parallel with the axis of the rotating fulcrum 7. The driven roller 45*a* is located below the drive roller 45, having its axis in parallel with the axis of the drive roller 45. The tension regulating roller 46 is made into contact with the intermediate transfer belt 44 on the inside side thereof remote from the front opening door 6.

The transfer cleaning means 48 is opposed to the idle roller 45*a*, the intermediate transfer belt 44 being interposed therebetween. The transfer cleaning means 48 incorporates the cleaning blade 49 which is located so as to make, at its one end, contact with the outer peripheral surface of the intermediate transfer belt 49 with a predetermined pressure, for scraping off toner remaining on the outer peripheral surface thereof. The toner which has been scraped off is accumulated in a container in the transfer cleaning means 48.

It is noted that a cleaning roller may be used for scraping off toner remaining on the outer peripheral surface of the intermediate transfer belt 44, in stead of the cleaning blade 49 in the embodiment 1.

The second transfer means 50 is located making contact with the outer peripheral surface of the drive roller 45, having its axis in parallel with the axis of the drive roller 45. A sheet 1 conveyed in the direction of the arrow 102 is made into contact with the intermediate transfer belt 44 by the second transfer roller 50 so as to transfer a toner image formed on the intermediate transfer belt 44 onto the surface of the sheet 1.

The fusing means 51 is provided in the conveying path 5*c*, on the side of the second transfer roller 50, near to the sheet discharge tray 53. The fusing means 51 incorporates therein a heating means such as a nichrome wire or a halogen lamp, so as to heat the toner on the sheet 1 up to a temperature at which the toner is melted, and then, it applies a predetermined pressure to the melted toner for fusing the same on the sheet. The fusing means 51 is provided on its sheet discharge side with curved guides for holding therebetween the sheet at its opposite surfaces so as to convey the sheet 1 along the conveying path 5.

A pair of discharge rollers 52 are located on the side of the sheet discharge tray 53, remote from the front opening door 6, having its axis in parallel with the axis of the rotating fulcrum 7, and having their outer peripheral surfaces made into contact with each other. The discharge roller 52 discharges the sheet having been conveyed, outside of the apparatus.

The sheet discharge tray 53 in the upper part of the casing 100 holds therein sheets discharged outside of the apparatus from the discharge rollers 52. The top surface opening door 201 is opened rearward around a rotating fulcrum, as a rotating center, having its axis laid horizontally.

Figure 2:
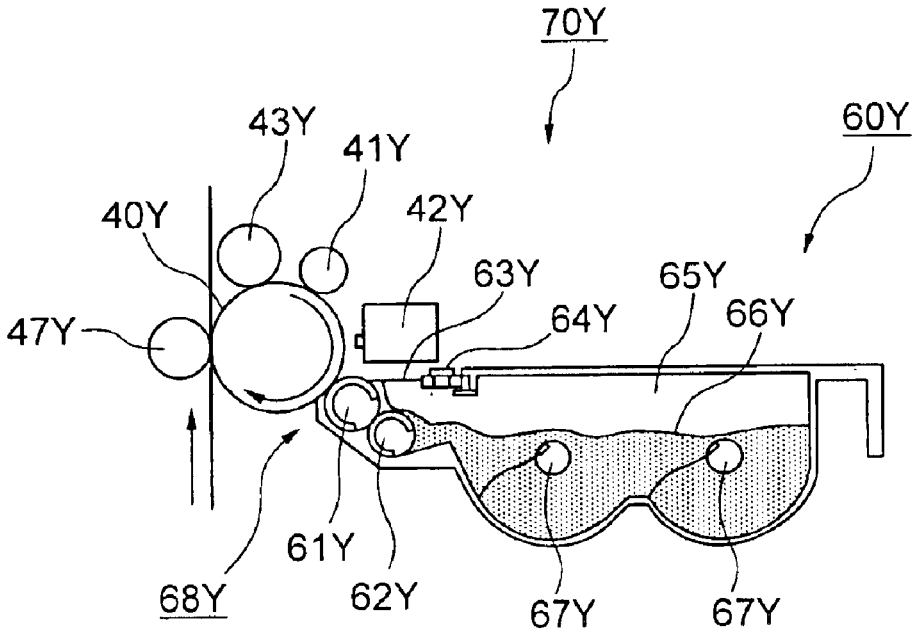
FIG. 2 is a sectional view illustrating one of developing means in the main portion of the embodiment 1, which is pulled out.

FIG. 2 is a sectional view illustrating one developing means which is pulled out from the main portion of the embodiment 1.

There are required four image forming means 70 in order to obtain a color image, but FIG. 2 shows only one image forming means 70 for yellow Y. Since the four image forming means 70 for yellow Y, magenta M, cyan C and black K have configurations identical with one another, explanation will be made of the configuration of the yellow image forming means 70Y as a representative example.

The yellow image forming means 70Y includes a photoconductive drum 40Y, a charge means 41Y, an exposure means 42Y, the developing means 60Y, and the cleaner means 43Y and the first transfer means 47Y in the form of a roller.

The photoconductive drum 40Y is formed on a cylinder coated over its outer surface with a photoconductive organic thin film, selenium or the like, on which a latent image and a toner image are formed. The photoconductive drum 40Y is located having its axis in parallel with the axis of the drive roller 45, and is rotated with its outer peripheral surface making contact with the outer peripheral surface of the intermediate transfer belt 44 on the side near the opening door 6.

The charge means 41Y is formed of a conductive rubber roller or the like, and is applied thereto with a voltage of about, for example, 2 kV in order to charge the outer surface of the photoconductive drum 40Y up to a predetermined voltage.

The exposure means 42Y includes, for example, LEDs arranged in one row widthwise of the photoconductive medium, and is located on the downstream side of the cleaner 43Y in the rotating direction of the photoconductive drum 40Y, being spaced from the outer surface of the photoconductive drum 40Y by a predetermined focal distance F with its irradiation being directed toward the outer peripheral surface of the photoconductive drum 40Y. The LED array includes LEDs having a number from 600 to 1,200 per inch (25.4 mm) for forming a latent image on the outer peripheral surface of the photoconductive drum 40Y.

The cleaning means 43Y is located on the downstream side of the first transfer means 47Y in the rotating direction of the photoconductive drum 40Y, having its axis in parallel with the axis of the photoconductive drum 40Y, and having its outer peripheral surface made into contact therewith.

In this developing means 60Y, the outer peripheral surface of the developing roller 61Y which is incorporated in parallel with the photoconductive drum 40Y, with a predetermined space from the outer peripheral surface of the photoconductive drum 40Y is made into contact with the outer peripheral surface of the photoconductive drum 40Y on the downstream side of the exposure means 42Y in the rotating direction of the photoconductive drum 40Y, and the yellow toner 66Y is accommodated in the developing means 60Y.

The developing means 60Y can be easily pulled out straightforward in the direction of the arrow 104, and can be also reinstalled after the opening door 6 shown in FIG. 1 is opened.

The developing roller 61Y is composed of a core made of metal such as stainless steel, and a conductive elastic film formed on the outer surface of the core, having a conductivity of about $10^3$ to $10^9$ Ω·cm and made of urethane rubber, silicon rubber or the like. The outer surface of the developing roller 61Y is rotated in the direction of the arrow 108, identical with that of the photoconductive drum 40Y.

The developing means 60Y incorporates therein the supply roller 62Y in parallel with the developing roller 61Y, the outer surface of the supply roller 62Y being made into contact with the outer peripheral surface of the developing roller 61Y.

The outer surface of the supply roller 62Y is made of, for example, porous sponge rubber, and is made into contact with the developing roller 61Y so as to be rotated in the same direction as that of the latter at the contact point, for supplying the toner 66Y to the developing roller 61Y.

The toner regulating blade 63Y is formed of a leaf spring having a stationary end side fixed to a housing for the developing means 60Y, and a free end side made into line-like contact with the developing roller 61Y along the mother line of the developing roller 61Y. The free end of toner regulating blade 63Y is made into contact with the outer peripheral surface of the developing roller 61Y with a predetermined pressure, and slides on the surface thereof as the developing roller 61Y is rotated so as to charge the toner and to form a thin toner layer having a predetermined thickness on the outer surface of the developing roller 61Y.

The toner regulating blade 63Y is located so that a straight line connecting between the stationary end thereof and the contact point thereof making contact with the developing roller 61Y is laid along a norm line standing on the outer surface of the intermediate transfer belt, in a section which is cut by a plane orthogonal to the axis of the developing roller 61.

This straight line becomes ideal if it is orthogonal to the outer surface of the intermediate transfer belt 44, and the angle between this straight line and the normal line standing on the outer surface of the intermediate transfer belt 44 is preferably be not grater than 10 deg, the smaller this angle, the smaller the size occupied by the toner regulating blade 63 in the stacking direction of the image forming means 70. Thus, the stacking pitches of the image forming means 70 can be decreased.

The developing means 60Y is composed of a toner accommodation part 65Y for accommodating therein the developing roller 61Y yellow toner 66Y, and a developing unit front end part 68Y formed on the photoconductive drum 40Y side of the toner accommodation part 65Y and incorporating therein the supply roller 62Y and also incorporating the toner regulating blade 63Y.

The first transfer means 47Y is arranged in parallel with the photoconductive drum 40Y, making contact with the photoconductive drum 40Y, the intermediate transfer belt 44 being interposed therebetween.

The cleaning means 43Y in the embodiment 1, which is a brush roller composed of a metal core made of stainless steel, and, for example, conductive fibers planted on the outer surface of the core, makes contact with the outer peripheral surface of the photoconductive drum 40Y so as to remove the toner remaining on the photoconductive drum 40Y without being transferred onto the intermediate transfer belt 44.

In this embodiment 1, the four image forming means 70 for printing a full color image with the use of black K, magenta M, cyan C and yellow Y are stacked one upon another in a vertical direction along the image transfer belt 44.

The endless intermediate transfer belt 44 is made of a conductive material such as polyimide or polycarbonate, and is vertically laid in an elongated form. The intermediate transfer belt 44 is wound on the drive roller 45, the driven roller 45*a* located below the drive roller 45 and the tension regulating roller 46 located between both rollers, and a suitable degree of tension is applied to the belt by the tension regulating roller 46.

The intermediate transfer belt 44 travels at a predetermined speed in the direction of the arrow 105 on the side which is made into contact with the photoconductive drum 40 as the drive roller 45 is rotated. One of the surfaces of the intermediate transfer belt 44 is made into contact with the four photoconductive drums 40 for forming color toner images of black K, magenta M, cyan C and yellow Y.

The first transfer rollers 47 which are opposed respectively to the color photoconductive drums 40K, 40C, 40M, 40Y and which are applied with predetermined voltages are arranged on the opposite side of the intermediate transfer belt 44, remote from the photoconductive drums 40, and are made into contact with the photoconductive drums 40 through the intermediary of the intermediate transfer belt 44 with a predetermined pressure.

Next, explanation will be made of the steps of forming a color image on a sheet in this electro-photographic apparatus in the embodiment 1. The four image forming means 70 forms color images of black k, magenta M, cyan C and yellow Y. Hereinbelow, the formation of an image of yellow Y will be explained. It is noted that the same steps can be taken for formation of a color image of any of black K, magenta M and cyan C.

When the charge roller 41Y is applied thereto with a predetermined voltage, the photoconductive layer on the outer surface of the photoconductive drum 40Y is uniformly charged.

LED beams corresponding to an yellow image are irradiated onto the photoconductive drum 40Y from the exposure means 42Y, so that the photoconductive layer is exposed. In the exposed part of the photoconductive layer on the outer surface of the photoconductive drum 40Y, the charge potential drops to a value near the ground level, and accordingly, a latent image which is invisible is formed.

Toner in a thin yellow toner layer which has been formed on the outer surface of the developing roller 61Y is allowed to stick to the latent image on the photoconductive drum 40Y so as to develop the same.

The thus formed yellow toner image is transferred onto the outer surface of the intermediate transfer belt 44 in the first transfer means 46Y.

The toner remaining on the photoconductive drum 40Y which has not yet been transferred onto the intermediate transfer belt 44 is removed by the cleaning means 43Y.

Color toner images of black k, magenta M and cyan C are formed by the corresponding image forming means 70, and are then transferred onto the intermediate transfer belt 44.

The toner images on the color photoconductive drums 40K, 40M, 40C, 40Y are formed with appropriate time differences in accordance with a traveling speed of the intermediate transfer belt 44 and the intervals of the photoconductive drums 40 in the traveling direction of the intermediate transfer belt 44. These toner images are superposed with one another when they are transferred onto the intermediate transfer belt 44 on which a full color toner image is thus formed.

Then, the full color toner image formed on the intermediate transfer belt 44 is transferred onto a sheet 1.

Sheets 1 set in the sheet cassette 2 are separated one by one by the sheet separating means 3, and are fed onto the vertical conveying path 5*a*. Each of the sheets 1 are nipped between a pair of the rotatable conveying means 4 which are faced to each other. At least one of the conveying means 4 is a drive roller for conveying the sheet 1 at a predetermined speed in a desired direction.

The sheet 1 is moved in the vertical conveying path 5*a*, the curved conveying path 5*b* and the horizontal conveying path 5*c* along the arrows 102*a*, 102*b*. When the sheet position detecting means 8 detects the leading end of the sheet 1, the registering rollers 9 for positioning the sheet 1 is once stopped. In this condition, the rotation of the conveying means 4 is continued so that the leading end of the sheet 1 is pressed against the nip parts of the registering rollers 9, that is, the contact parts of the opposed rollers, and accordingly, the leading end of the sheet 1 is set so as to be parallel with the axes of the registering rollers 9.

The registering roller 9 is driven again with a timing with which the leading end of the sheet 1 and the position of the leading end of the toner image formed on the intermediate transfer belt 44 have a predetermined positional relationship therebetween. The second transfer means 50 makes the outer surface of the sheet 1 into contact with the intermediate transfer belt 44 so as to transfer the toner image from the intermediate transfer belt 44 onto the sheet 1.

The sheet 1 is conveyed into the fusing means 51 so as to fix the transferred toner image on the outer surface of the sheet 1.

The sheet 3 onto which the toner sticks is heated by the fusing means 51 up to a temperature at which the toner is melted. Since the temperature of the outer surface of the fusing means 51 is about 160 deg.C., and since the melting point of the toner on the sheet 1 is about 100 deg.C., the toner can be melted in a short time during passing through the fusing means 51.

In the fusing means 51, the melted toner is pressed against so as to be made into close contact with the sheet 1 during fusing with a pressure between a pair of rollers, between a roller and a belt or the like, and thereafter the toner is self-cooled.

The sheet after completion of the fusing, is conveyed in the directions of the arrows 106*a*, 106*b* in the conveying path 5, and is discharged onto the sheet discharge tray 53 by the discharge rollers 52.

With the repetitions of the above-mentioned series steps, sheets on which color images are formed are successively obtained.

The toner regulating blade 63Y is formed of a metal leaf spring fixed to a toner regulating blade attaching means 64 in the toner accommodating part 65Y with the use of a screw or the like, and is extended in a direction substantially orthogonal to the intermediate transfer belt 44 vertical stretched, that is, a substantially horizontal direction.

The distal end of the toner regulating blade 63Y is made into contact with the outer surface of the developing roller 61A around the apex thereof, with a predetermined pressure so as to regulate a thickness of the toner sticking to the outer surface of the developing roller 61 in order to form a thin toner layer having a predetermined volume and charged with a predetermined electric charge.

The part of the toner regulating blade 63Y which is made into contact with the outer peripheral surface of the developing roller 61 in the vicinity of the apex of the outer surface of the developing roller 61 is not limited to the actual distal end of the toner regulating blade 63. That is, the part made into contact therewith may be an angled part or a curved part formed by bending the toner regulating blade 63.

The toner regulating blade 63Y is located so as to have a positional relationship and a structure such that a predetermined flexion is caused when it makes contact with the outer peripheral surface of the developing roller 61Y, that is, it is located so as to make contact with the outer surface of the developing roller 61Y in the following direction from the upstream side thereof in the rotating direction thereof, that is, in the same direction as the traveling direction of the outer surface of the developing roller 61Y.

The toner accommodation part 65 incorporates toner agitating means 67 for agitating the toner 66 so as to feed the toner 66 from the supply roller 62 to the developing roller 61.

The developing means 60 in which toner 66 is consumed, can be pulled out substantially rectilinearly in its entirety in the direction of the arrow 104, and a new developing means 43 can be replaced therewith.

In order to reduce the entire dimensions of the apparatus, it is required to mount the image forming means 70 each including the photoconductive drum 40, the charging means 41, the exposure means 42, the developing means 43 and the cleaning means 43, with a high density. That is, the photoconductive medium pitches among the photoconductive drums 40 is required to be set to a value which is small as possible, and the photoconductive drum 40, the charging means 41 and the exposure means 42, the developing means 60 and the cleaning means 43 which constitute each one of the developing means 70 are arranged so as to prevent them from interfering with one another.

Meanwhile, even though the apparatus is a small-sized, the volume of toner 66 accommodated in the toner accommodation part 65 is preferably large as possible.

In order to miniaturize the image forming device, it is required to decrease the pitches or the intervals of the image forming means 70 for the color toners, which are stacked one upon another, to a value which is small as possible.

The developing unit front end part 68 and the exposure means 42 in the vicinity of the developing roller 61 in each developing means 60 are superposed with each other in the heightwise direction.

If toner sticks to the front end of the LED array in the exposure means 42, inferior exposure is caused, resulting in the presence of white streaks, and the image quality is lowered. Thus, it is preferable to arrange the LED array in the exposure means 42 so that its optical axis extends in a direction which is horizontal or inclined downward from the horizontal direction.

In the embodiment 1 shown in FIG. 2, the LED is arranged so that its optical axis is inclined downward at an angle of about 3 to 5 deg. from the horizontal direction. It is noted that this angle of the optical axis should not be limited to the value shown in FIG. 2, but the inclined angle may be set to a value larger the aforementioned value within such a range that it is prevented from interfering with the developing means.

Next, explanation will be made of a mechanism for printing opposite surfaces of a medium.

The bypass conveying path 56 branches, in the first branch means 58 downstream of the fusing means, from the main conveying path 5 by a diverging means 11 which is provided in the sheet discharge path 55 so as to convey a sheet to the reversing conveying path 54. The diverging means 11 changes over the conveying path for the sheet 1 between the sheet discharge path 55 and the bypass conveying path 56 by means of an actuator which is not shown.

The sheet 1 having a color image on the front side which is fused by the fusing means 51 is conveyed through the bypass conveying path 56 in the direction of the arrow 107, being held between the return rollers 4*c* in order to print the backside surface thereof.

The sheet 1 conveyed through the bypass conveying path 56, is inserted into the reversing conveying path 54 so that its conveying direction is reversed so that the trailing end thereof is turned into the leading end.

The sheet 1 conveyed through the bypass conveying path 56 is conveyed through the return conveying path 57 in the direction of the arrow 108 by the second branch means 59, passing through the horizontal conveying path 5*c*. Thus, a full color image is transferred onto the backside surface of the sheet 1 when it passes through the second transfer means 50, and then the toner is fused by the fusing means 51 before it is discharged onto the sheet discharge tray 53 from the discharge conveying path 55.

The opening door 6 only incorporates the vertical conveying path 5*a* which is a part of the main conveying path 5 for conveying sheets which are fed from the sheet cassette 2, being separated from one another, and the reversing conveying path 54 for switching back the sheet 1, being stacked in two layers.

Since the reversing conveying path 54 is laid in a vertical direction or a gravitational direction, it is sufficient to pinch only the upper end of the sheet 1 to be reversed, between the conveying rollers 4*c*.

In the present invention, the conveying rollers 4*c* for conveying the sheet 1 which is fed into the reversing conveying path 54 or which is taken out from the reversing conveying path 54 is not provided in the opening door 6 but is provided only in the apparatus body. Thus, since it is not required to additionally provide a power transmission means for transmitting a power for driving the conveying rollers 4*c* which are provided in the opening door 6, the reversing conveying path 54 may have a mere slit-like shape in order to accommodate only one sheet. Thus, the configuration thereof can be simplified, and accordingly, the opening door 6 can be thinned.

Thus, both vertical conveying path 5*a* for conveying sheets which are fed from the sheet cassette 2, being separated from one another by the sheet feed means 3, and reversing conveying path 54 in two layers are only in the opening door 6. Further, since no conveying rollers for conveying the sheet 1 which is to be reversed and conveyed in the reversing conveying path 54 are provided in the opening door 6, the thickness Th of the opening door 6 can be reduced.

As a result, the widthwise size W of the electrophotographic apparatus, as viewed in FIG. 1 can be reduced so as to decrease the floor area of the electrophotographic apparatus, thereby it is possible to miniaturize the electrophotographic apparatus.

Figure 3:
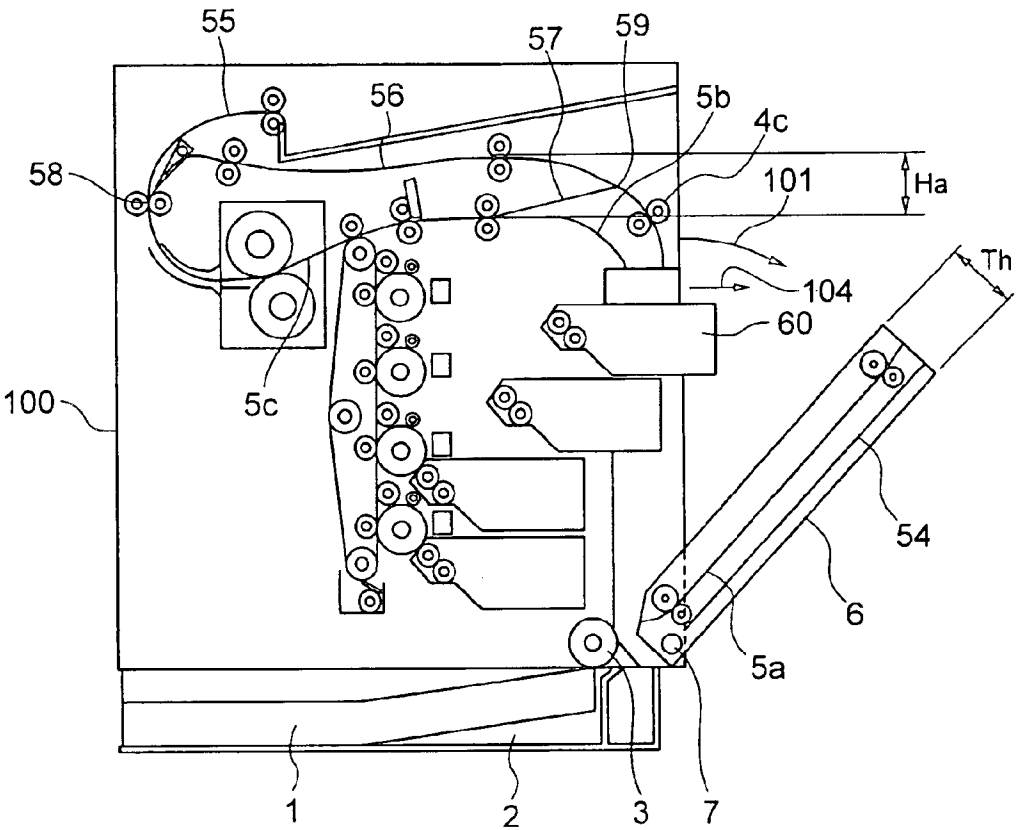
FIG. 3 is a sectional view illustrating the electrophotographic apparatus in a condition in which an opening door is opened for replacement of the developing means.

FIG. 3 is a view for explaining a condition in which the opening door is opened in the embodiment 1 in order to replace the developing means. In the embodiment 1, when the opening door 6 is opened in the direction of the arrow 101 about the rotating fulcrum 7, the developing means 50 can be pulled out in the direction of the arrow, thereby it is possible to facilitate the maintenance or the replacement of components.

Figure 4:
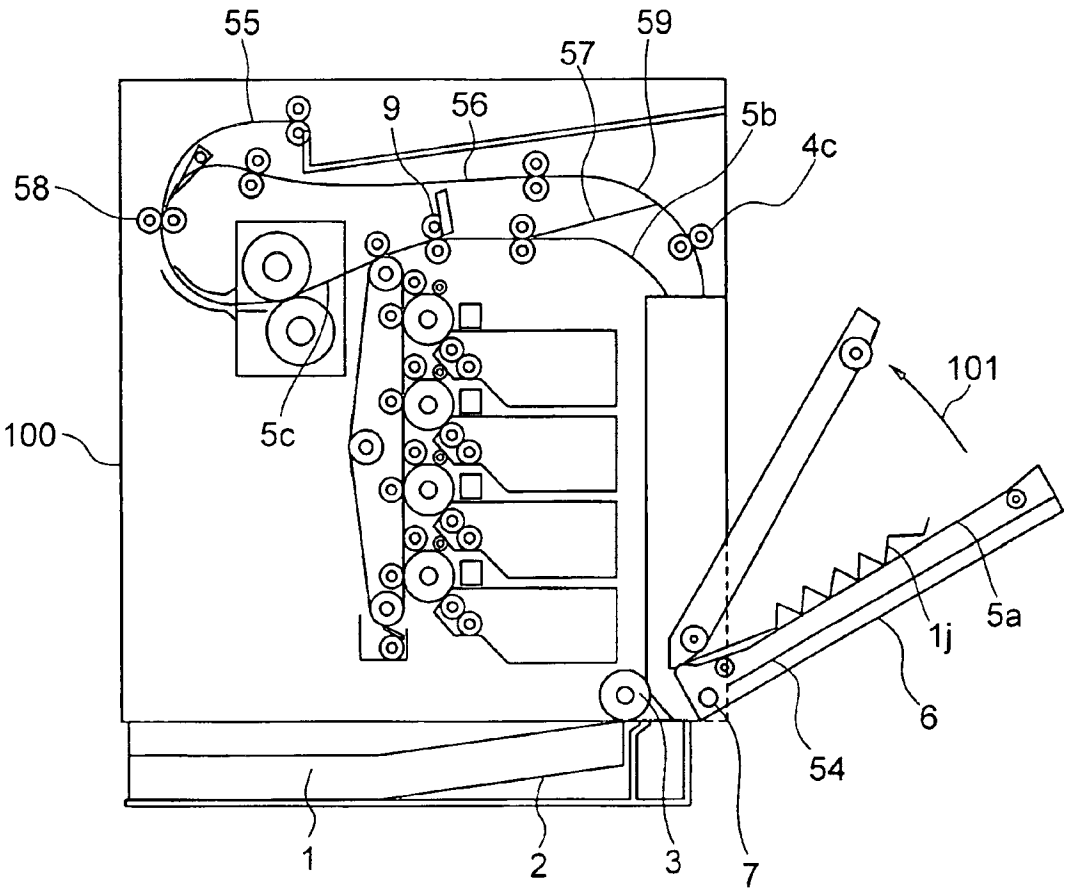
FIG. 4 is a sectional view illustrating the electrophotographic apparatus in the embodiment 1 in a condition in which a jam of sheets which occurs in a main conveying path is disposed.

FIG. 4 a view for explaining disposal of a jam of sheets in the main conveying path 5 in the embodiment 1.

By adding a structure for opening the vertical conveying path 5*a* in the opening door to the mechanism shown in FIG. 3, the disposal of a jam can be facilitated even though a sheet jam 1*j* occurs in the main conveying path 5.

Next, explanation will be made of the configuration of the bypass conveying path during double face printing.

Figure 5:
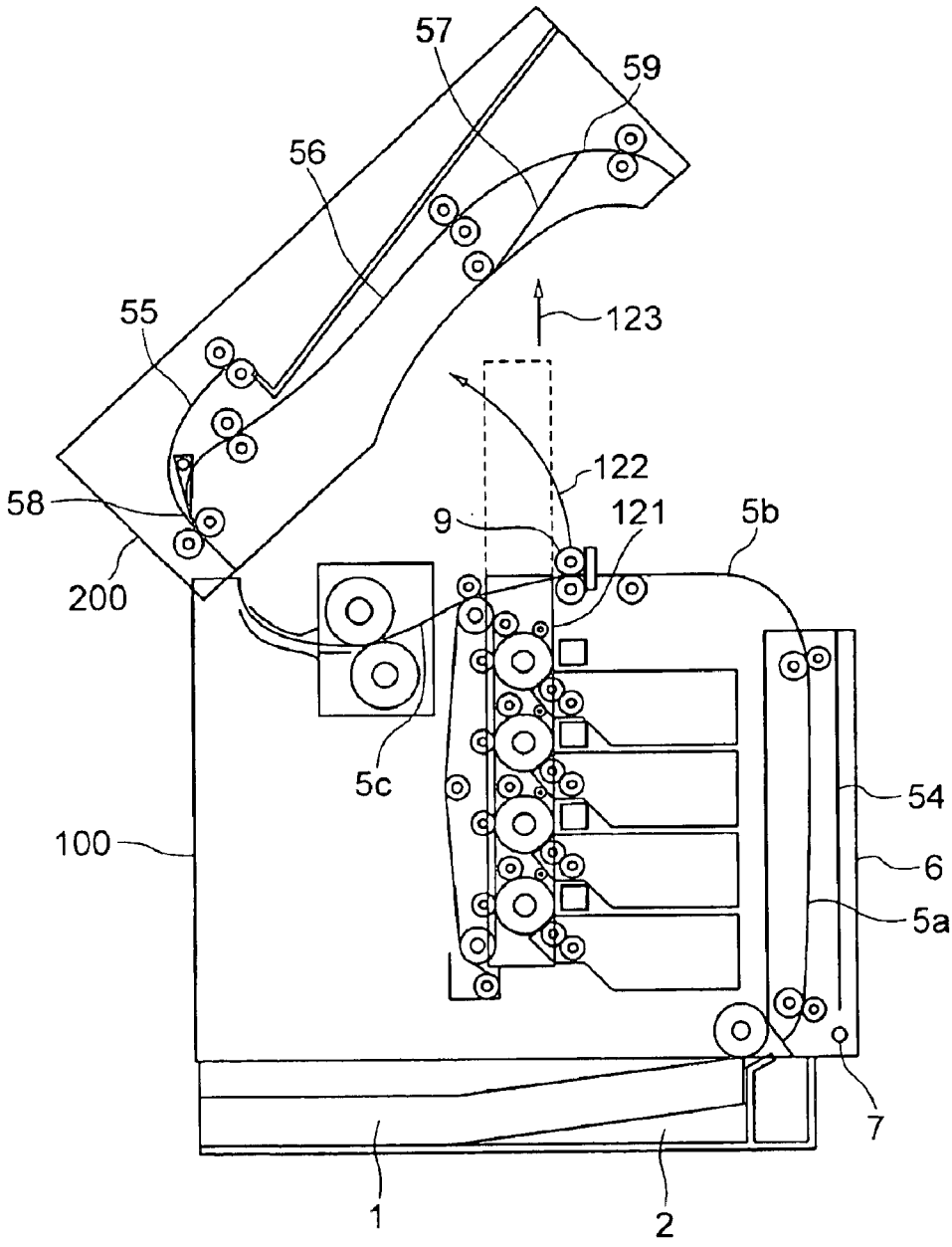
FIG. 5 is a sectional view illustrating the electrophotographic apparatus in the embodiment 1 in a condition in which a casing upper part is opened.

FIG. 5 is a view illustrating the electrophotographic apparatus in the embodiment 1 in a condition in which the casing upper part is opened.

The casing upper part 200 includes the curved conveying path 5*b*, at least the upper surface of the horizontal conveying path 5*c*, the bypass conveying path 56 and the return conveying path 57, and when it is turned in the direction of the arrow 122, the upper surface of the casing 100 can be opened.

After the casing 200 is opened, the curved conveying path 5*b* and the horizontal conveying path 5*c* are exposed, and accordingly, the disposal of a sheet jam can be facilitated even though the sheet jam occurs in the curved conveying path 5*b* or the horizontal conveying path 5*c*.

The photoconductive drums 40K, 40C, 40M, 40Y for forming images of respective colors YMCK, the charge rollers 41K, 41C, 41M, 41Y, and the cleaner means 43K, 43C, 43M, 43Y are arranged in the vertical direction at predetermined intervals along the intermediate transfer belt 44. They can be integrally incorporated with one another so as to form a photoconductive unit 121 which is independent from the casing 100.

With this configuration, the photoconductive unit 121 can be pulled out as one unit in the direction of the arrow 123, and accordingly, the replacement of a deteriorated or scratched photoconductive medium with a new one can be facilitated, that is, the maintenance can be simplified.

Figure 6:
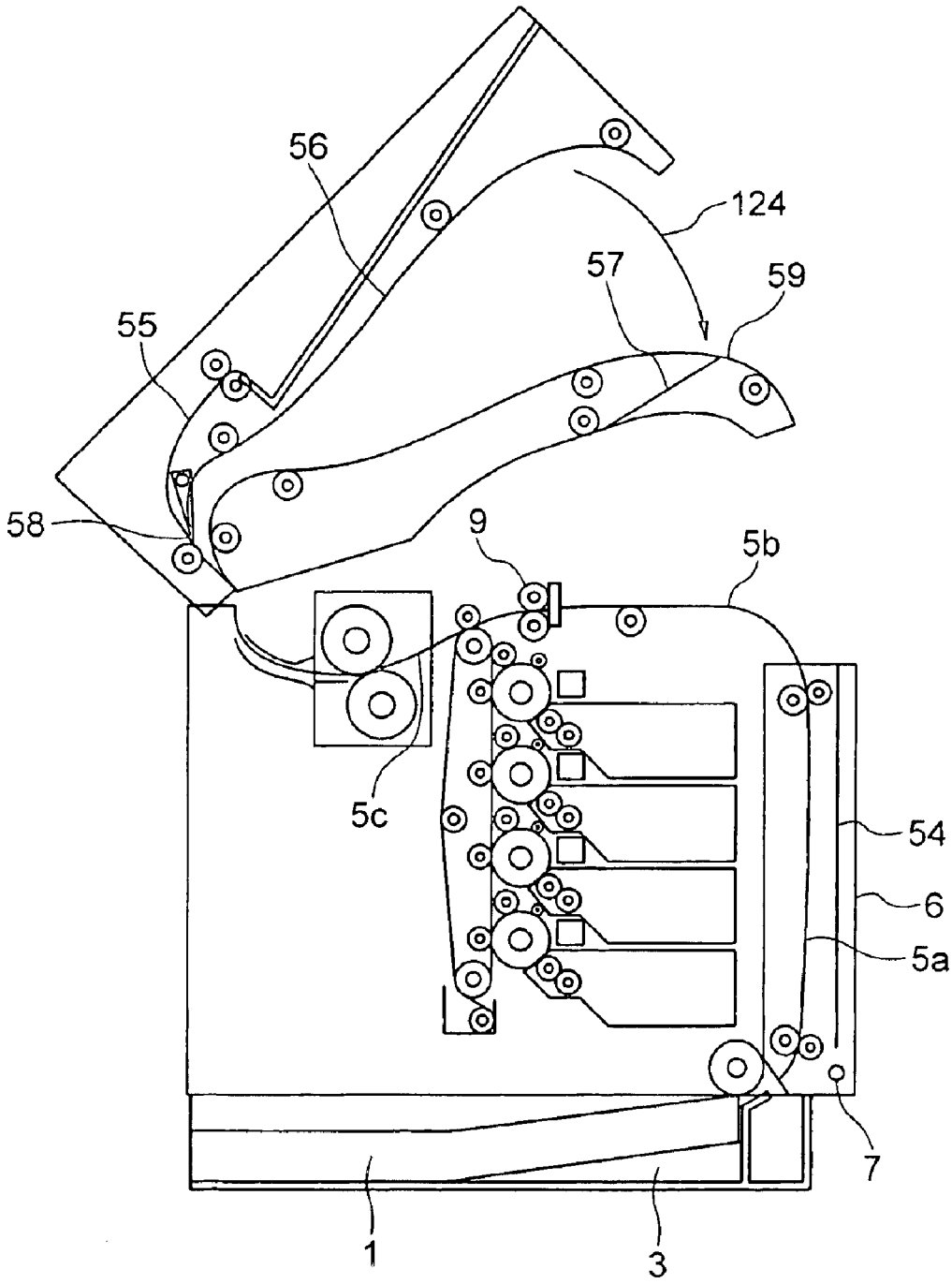
FIG. 6 is a sectional view illustrating the electrophotographic apparatus in the embodiment 1 in a condition in which a bypass conveying path is exposed.

FIG. 6 shows the electrophotographic apparatus in the embodiment 1 in such a condition that the bypass conveying path is exposed.

In the case of occurrence of a jam in the bypass conveying path 56, the part below the bypass conveying path 56 is rotated in the direction of the arrow 124 so as to expose the bypass conveying path 56, and accordingly, disposal of the jam can be facilitated.

Figure 7:
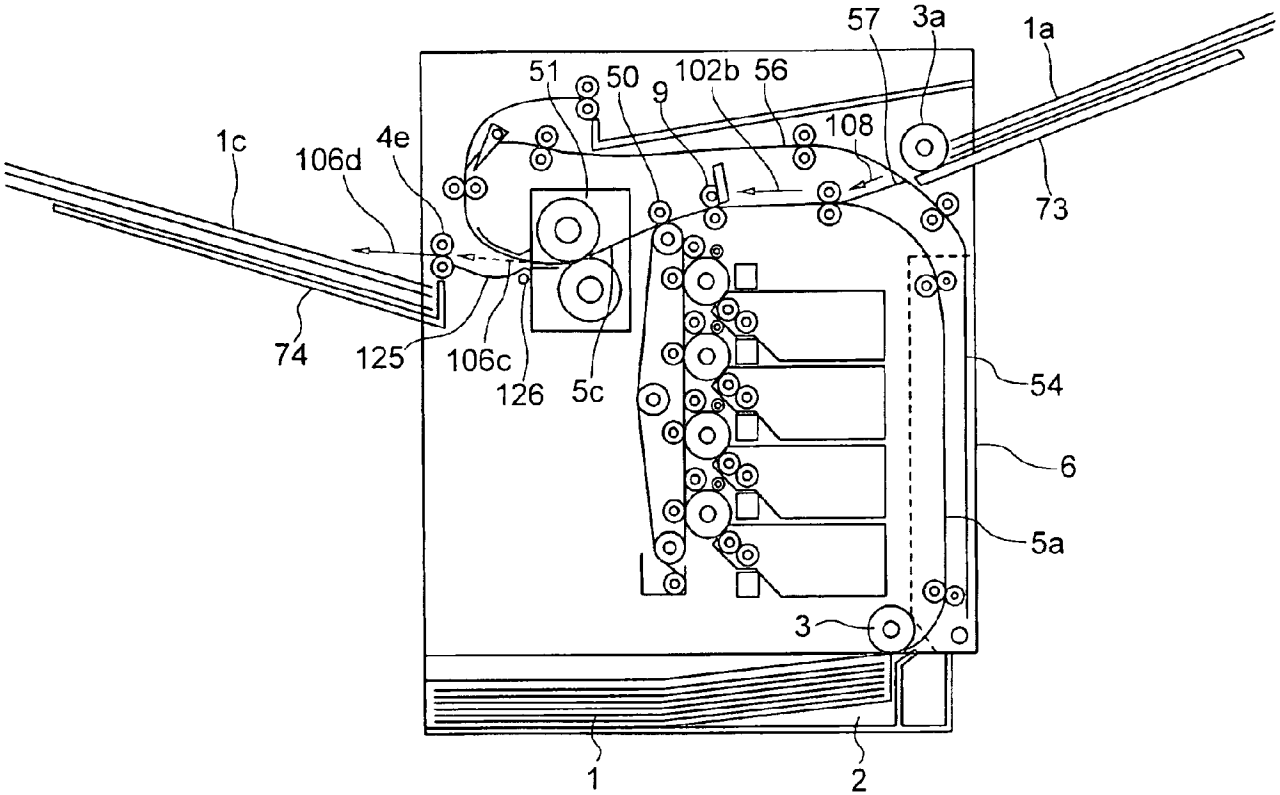
FIG. 7 is a sectional view illustrating the electrophotographic apparatus in the embodiment 1 in a condition in which a sheet is manually inserted.

FIG. 7 shows the electrophotographic apparatus in such a condition that manual insertion of a sheet is carried out in the embodiment 1.

A specialty sheet such as a cardboard or a transparency film, which is different from the sheets 1 to be printed set in the sheet cassette 2, is inserted through a manual sheet tray 73. In such a case that a specialty sheet such as a cardboard having a high stiffness cannot be conveyed through the conveying path, it is desired that the conveying path is straight as possible as it can.

In the present invention, the manual insertion tray 73 is provided substantially on an extension of the return conveying path 57.

Further, with the provision of a sheet feed means 3*a*, sheets la manually inserted can be separated from one another one by one.

Further, a guide 125 after the fusing means, for guiding a sheet 1 discharged from the fusing means 51 is rotatably provided about a fulcrum 126 so as to discharge a specialty sheet such as a cardboard discharged from the fusing means in the direction of the arrow 106*c*. The specialty sheets such as cardboards are discharged outside of the casing 100 in the direction of the arrow 106*d* by conveying rollers 4*e*, and are stacked in the discharge tray 74.

With the configuration shown in FIG. 7, sheets 1*a* fed in the manual insertion tray 73, are separated one by one by the paper feed means 3*a*, and are conveyed through the return conveying path 57 and the horizontal conveying path 5*c* along the direction of the arrow 102*b*. By way of the registering rollers 9, toner images are transferred on to the specialty sheets 1 in the second transfer means 50, and are then fused by the fusing means 51 before the sheets are discharged.

With the configuration of the embodiment 1, the conveying path from the manual insertion tray 73 to the discharge tray 74 can have a less number of parts having a large curvature or curved parts.

Thus, since the rectilinear conveying path can be embodied, a sheet 1 having a high stiffness, such as a cardboard can be used.

Next, explanation will be made of double face printing operation with reference again to FIG. 1.

In the case of double face printing, the conveying direction of a sheet 1 having a front side for which transfer and fusing of a toner image is completed, is diverged by the diverging means 11 incorporated in the first branch means 58 in the main conveying path 5. That is, the sheet 1 is shifted from the main conveying path 5 into the bypass conveying path 56, then is conveyed in the direction of the arrow 107, and is once stored in the reversing conveying path 54.

After the trailing end of the sheet 1 has passed through the second branch means incorporated in the bypass conveying path 56, when the sheet has been stored in the reversing conveying path, the rotation of the conveying rollers 4*c* are reversed so as to convey the sheet in the direction of the arrow 108 (reverse direction).

The leading end of the sheet 1 enters into the return conveying path 57 in the second branch means, being advanced in the direction of the arrow 108, and is led into the horizontal conveying path 5. Then, the sheet 1 is advanced in the direction of the arrow 102*b*, and a full color toner image which has been previously formed on the intermediate transfer means is transferred onto the backside surface of the sheet 1 in the second transfer means 50, and is fused by the fusing means 51 in order to form an image on the backside surface of the sheet 1, that is, the double face printing is completed.

Figure 8:
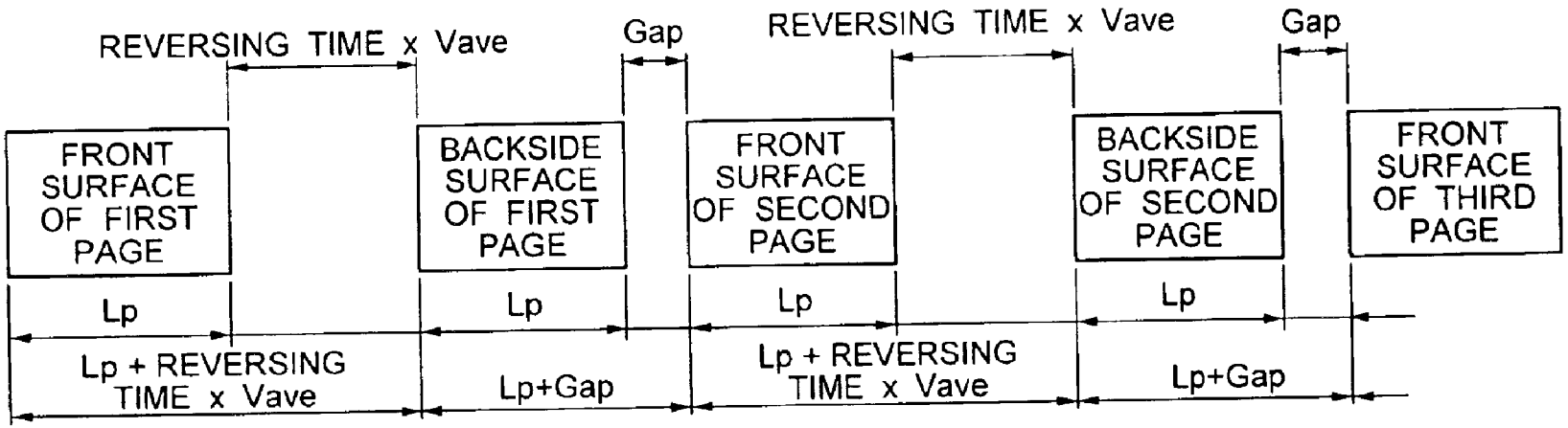
FIG. 8 is a view illustrating a printing order and an example of a gap between sheets during conventional double face printing.

FIG. 8 shows an example of the printing order and gaps between sheets during conventional double face printing.

The above-steps are repeated for every sheet, the printing is carried out for the front surface of a first sheet, the backside surface of the first sheet, the front surface of a second sheet, the backside surface of the second sheet . . . in the printing order.

With this printing order, a dead time is present until printing is started on the backside surface of the first sheet after the printing is completed on the front surface thereof. Accordingly, the printing speed per minute becomes lower than that for single face printing.

That is, in FIG. 1, after the trailing end of the sheet having a front surface for which printing is completed is fed out from the fusing means 51, during a period in which the trailing end of the sheet conveyed through the bypass conveying path 56 passes through the second branch means 59, the sheet 1 is stored in the reversing conveying path 54 in its entirety so as to be conveyed in the reverse direction of the arrow 102*a* so that the leading end of the sheet reaches the second transfer means 50, the image forming means incorporating the developing means 60, the photoconductive mediums 40 and the intermediate transfer belt 44 falls in the so-called waiting condition so that the time interval until the printing on the backside surface thereof becomes longer, the printing speed per minute is lowered.

Until the printing of the front side surface of the second sheet is started after printing is completed for the backside surface of the first sheet, since the second sheet can be picked up by the supply means 3 so that a predetermined sheet gap Gap can be ensured with the timing of conveying the trailing end of the backside surface of the first sheet from the return conveying path 57 onto the horizontal conveying path 5, the sheet gap Gap between the first sheet and the second sheet can be equal to that in the case of single face printing, thereby it is possible to prevent the printing sheet from lowering.

The trailing end of the first sheet 1 passes through the fusing means 51, passing through the bypass conveying path 56, and is then once stored in the reversing conveying path 54 through which the conveying direction is reversed so that the sheet 1 passes through the return conveying path 57. Thus, the sheet 1 reaches the second transfer means 50. Until then, the sheet 1 can be conveyed at a speed higher than the transferring conveying speed by the second transfer means 50, and accordingly, the reversing time, that is, the dead time can be shortened.

However, the printing speed of the double face printing cannot be set to be completely equal to that of the single face printing. That is, the sheet interval from the completion of the printing on the front surface of the first sheet to the start of the printing on the backside surface thereof is the product of the time required for reversing the sheet and an averaged speed Vave during this period. This product becomes larger than the sheet gap Gap in such a case that sheets 1 are successively fed from the sheet cassette.

Figure 9:
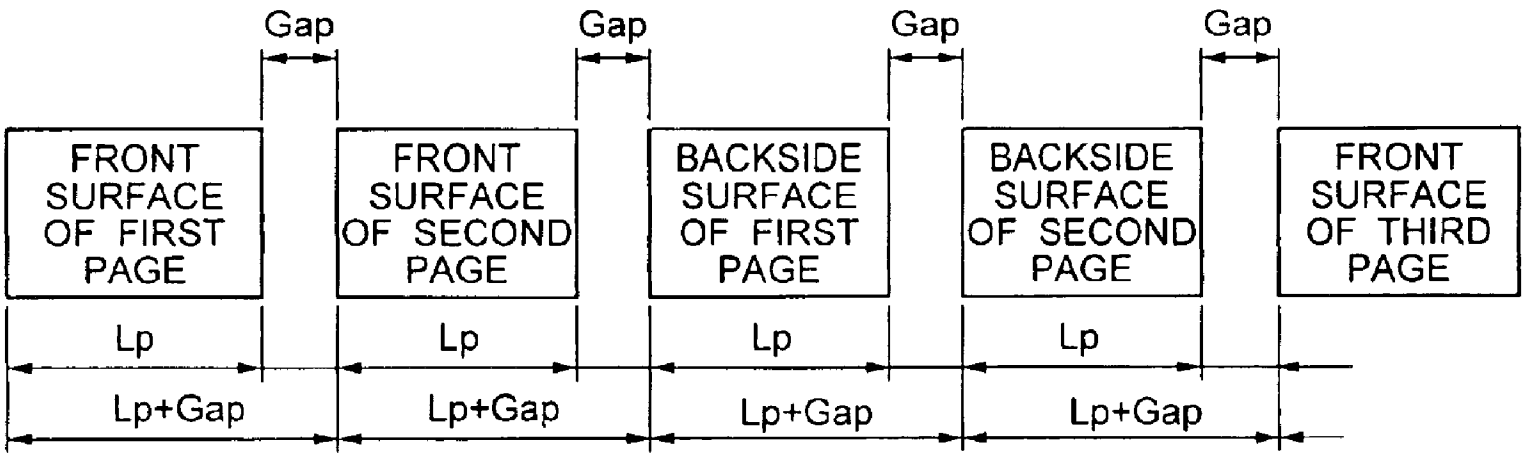
FIG. 9 is a view illustrating a printing order and an example of a gap between sheets during double face printing according to the present invention.

FIG. 9 shows an example of a printing order and gaps between sheets during double face printing according to the present invention.

In order to make the printing speed of the double face printing equal to that of the single surface printing, it is desirable to carry out printing steps in such a way that the second sheet 1 is picked up while the first sheet 1 is conveyed through the reversing conveying path 54 for printing the backside surface of the first sheet after the front surface thereof is printed, the front surface of the second sheet is printed after printing on the front surface of the first sheet is competed, while the first sheet is reversed, and then, printing is made on the backside surface of the first sheet which is then discharged while the second sheet is withdrawn in the reversing conveying path.

Figure 10:
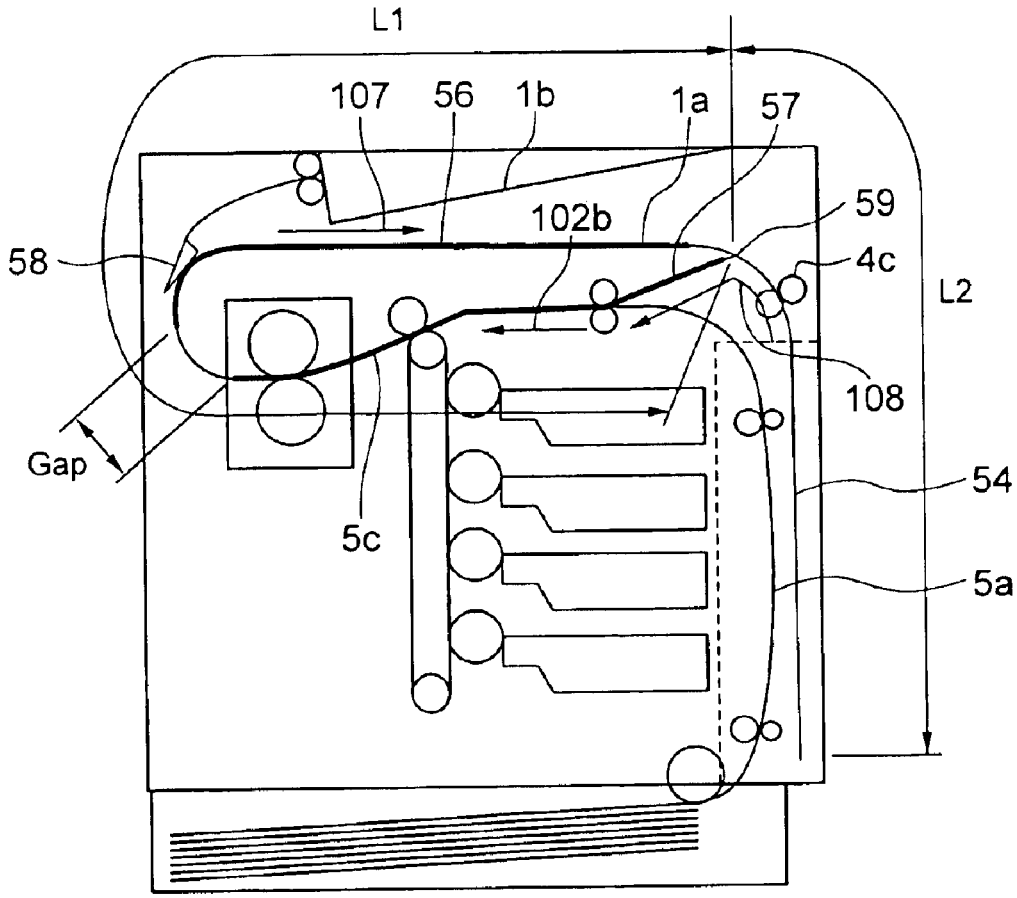
FIG. 10 is a view illustrating an embodiment of a recording medium conveying path for materializing the printing order shown in FIG. 9.

FIG. 10 is a view illustrating an embodiment of a recording medium conveying path for embodying the printing order as shown in FIG. 9.

Referring to FIG. 10, L1 is a length of the looping route from and to the second branch means 59 on the bypass conveying path 56 by way of the second transfer means 50 of the horizontal conveying path 5c, the fusing means 51, the first branch means 58 and the bypass conveying path 56, and L2 is a length of the reversing conveying path 56 from the second branch means 59 to a position in the vicinity of the sheet cassette 2.

It is required to satisfy the following relationship:

$$L2>\text{Pmax}$$

where Pmax is a maximum length of a sheet 1 which should be stored in the reversing conveying path 54.

Next, in order to embody the printing order shown in FIG. 9, it is desirable to satisfy the following relationship:

$$L1>(2\times P\text{max}+\text{Gap})$$

where Gap is the gap between the sheets as shown in FIG. 10.

By determining the conveying length L1 as mentioned above, the trailing end of the first sheet which is conveyed from the reversing conveying path 54 to the horizontal conveying path 5c by way of the return conveying path 57 in order to print the backside surface thereof, is prevented from impinging upon the leading end of the second sheet having the front surface for which the printing has been completed, and entering into the reversing conveying path 54 from the bypass conveying path 56, and accordingly, it is possible to restrain occurrence of a jam, thereby it is possible to materialize a stable sheet conveyance.

The conveying roller 4c which pinches the sheet 1 therebetween within the reversing conveying path 54, is rotated clockwise in order to feed out the first sheet which has been withdrawn, and is then rotated counterclockwise when the sheet detecting means 120 detects such a fact that the feed-out of the first sheet is completed, so as to feed the second sheet conveyed from the bypass conveying path 56, into the reversing conveying path 54.

Figure 11:
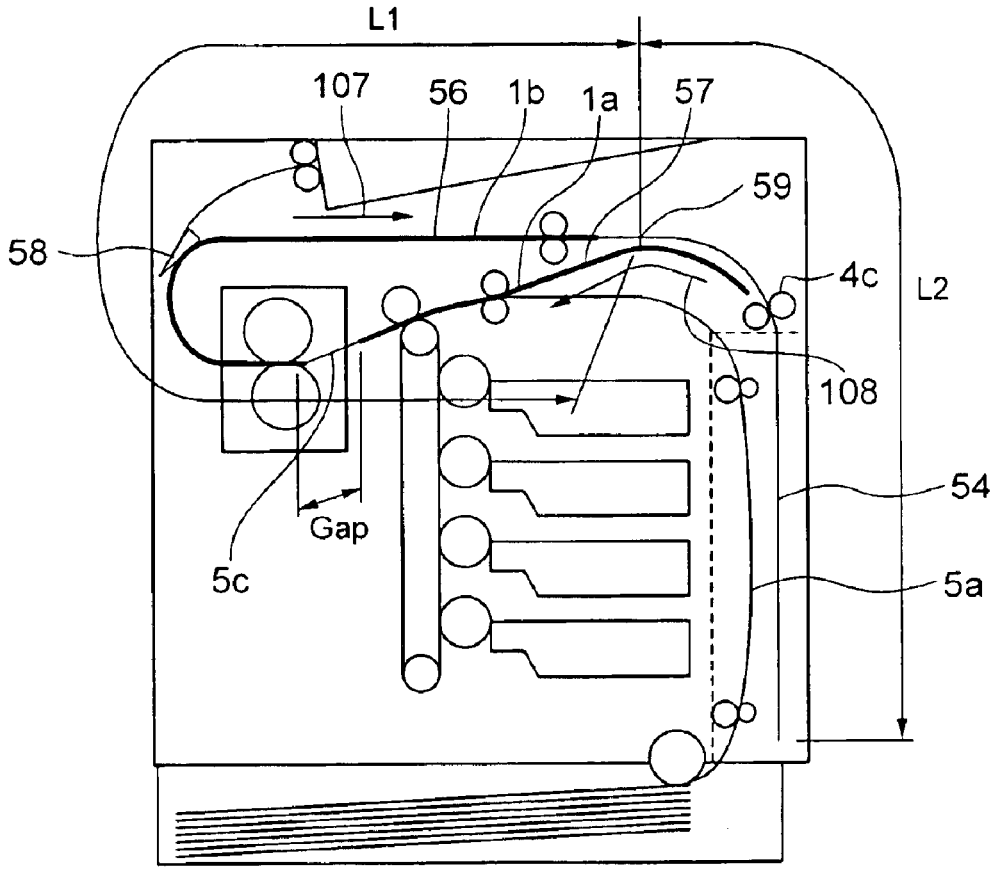
FIG. 11 is a view illustrating an embodiment of a recording medium conveying path for materializing the printing order shown in FIG. 9.

FIG. 11 shows an embodiment in which the length L1 of the looping route from and to the second branch means 59 on the bypass conveying path by way of the second transfer means 50 of the horizontal conveying path 5c, the fusing means 51, the first branch means 58 and the bypass conveying path 56 is shorter than that in the embodiment shown in FIG. 10.

Figure 12:
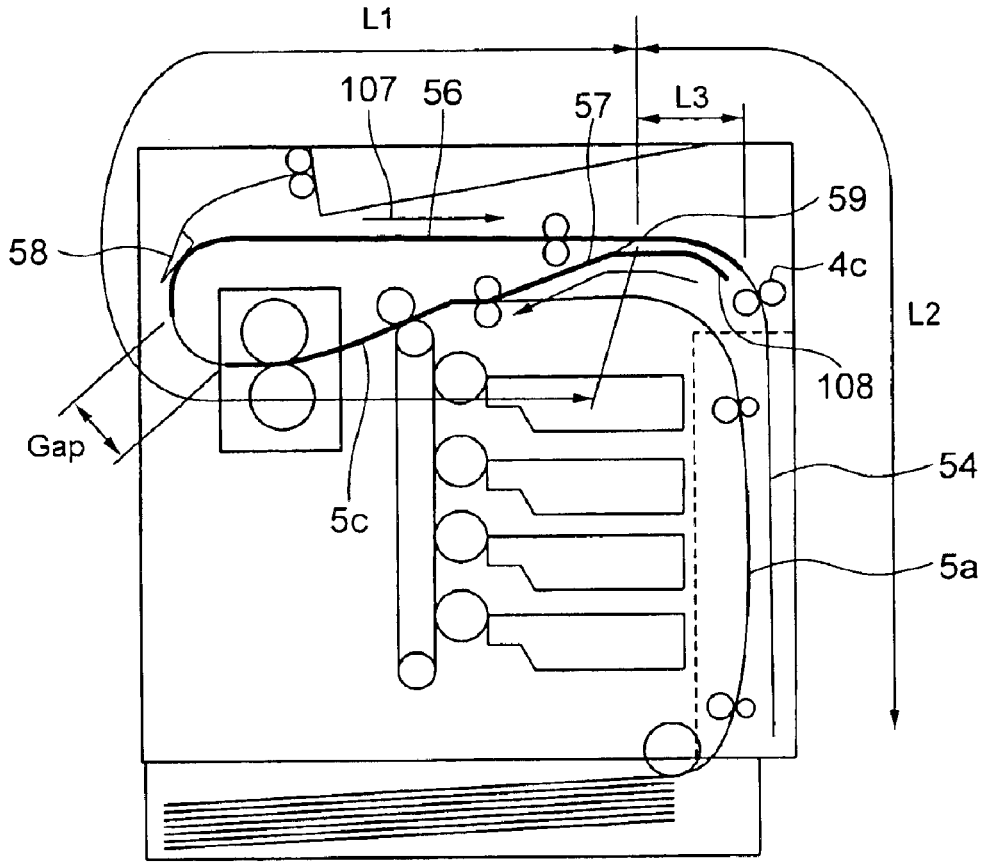
FIG. 12 is a view illustrating a condition in which a sheet la and a sheet 1*b* shown in FIG. 11 pass by each other, being overlapped with each other.

FIG. 12 shows such a condition that a sheet la and a next sheet 1b shown in FIG. 11 pass by each other being overlapped with each other.

In an embodiment 3, the conveying length L1 extending from the second branch means 59 by way of the return conveying path 57 and the bypass conveying path 56, is given by:

$$L1<(2\times P\text{max}+\text{Gap})$$

The sheet 1a which is fed out form the reversing conveying path 54 and is then conveyed in through the return conveying path 57 for printing the backside surface thereof after the printing has been already completed for the front surface thereof, passes by the next sheet 1b being overlapped with each other in a part of the conveying path from the second branch means 59 to the reversing conveying path 54.

Referring to FIG. 11, at the time point when the leading end of the sheet 1b having the front surface for which printing is completed reaches the second branch means 59, the trailing end of the sheet la which is fed out from the reversing conveying path 54 for printing the backside surface thereof, is still located in the reversing conveying path.

As shown in FIG. 12, during the period until the leading end of the sheet 1b has passed through the second branch means 59 and enters into the return conveying path 57 after the leading end of the sheet 1b passes through the second branch means 59, the sheet 1a and the sheet 1b pass by each other in the conveying path.

The length L2 in a range where the sheets pass by each other, measured from the second branch means 59, is exhibited by:

$$L3=(2\times P\text{max}+\text{Gap}-L1).$$

In the range where the sheets pass by each other, two sheets are conveyed in opposite directions, being overlapped with each other.

Should the conveying rollers 4c be provided in this range, sheets could not pass by each other. Thus, such a configuration that the conveying rollers 4c for pinching the sheet is released from the pinching condition would be required. On the contrary, according to the present invention, since no conveying rollers 4c are provided in the range L3 where the sheets pass by each other, no releasing mechanism for the conveying rollers is required, thereby it is possible to materialize the pass-by of the sheets with a simple configuration.

Figure 13:
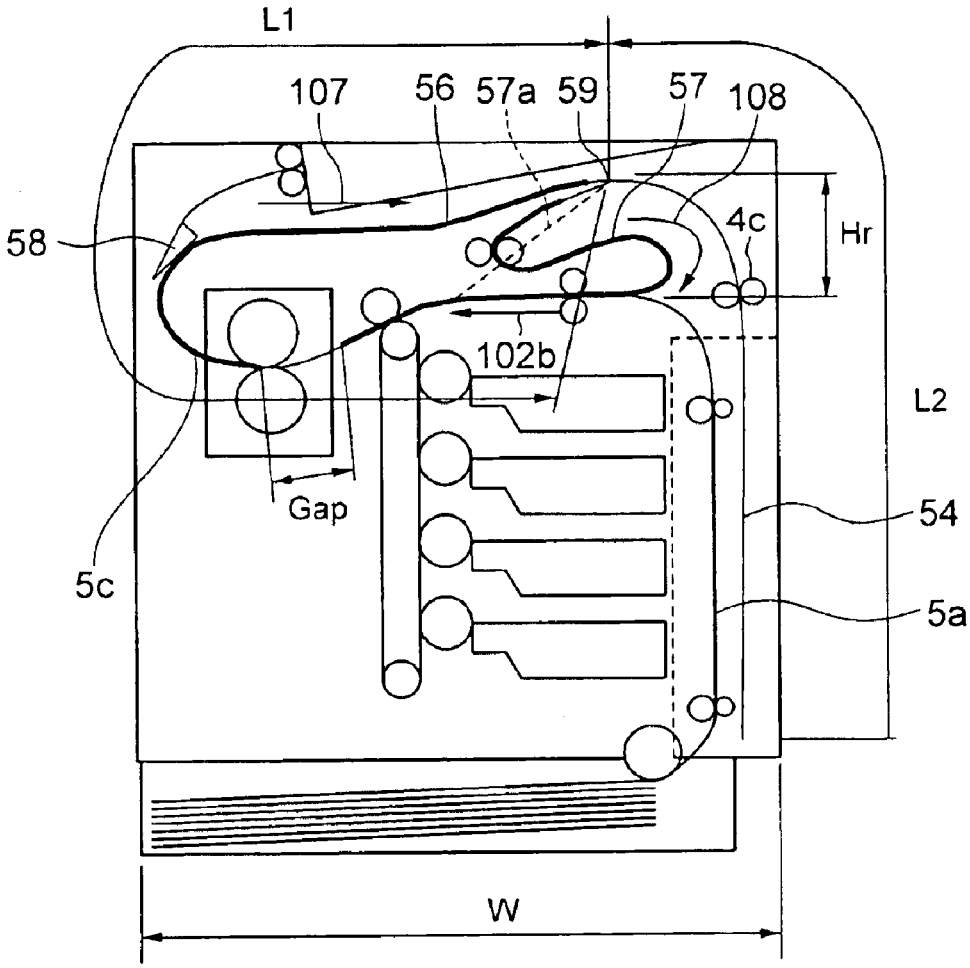
FIG. 13 is a view illustrating an embodiment in which the return conveying path from a second branch means is formed in an S-like shape.

FIG. 13 is a view illustrating an embodiment 4 in which the return conveying path 57 from the second branch means 59 is formed in an S-like shape.

In the embodiment 4, the return conveying path 57 is curved into an S-like shape, and accordingly, $$L1>(2\times P\max+\mathrm{Gap})$$

can be ensured, similar to the embodiment shown in FIG. 10. Thus, the sheet 1*b* which is conveyed through the bypass conveying path 56 and enters into the reversing conveying path 54 after a toner image is transferred onto and fixed on the front surface thereof, the sheet 1*a* which is fed out from the reversing conveying path in which the leading end thereof has been reversed into the trailing end, and enters into the bypass conveying path 5*c* in order to transfer and fix a toner image on the backside surface thereof, can be advanced in their respective directions without making contact with each other in the second branch means 59.

With the use of the above-mentioned configuration, the conveying path lengths L1, L2 exhibited by:

$$L1>(2\times P\max+\mathrm{Gap})$$

$$L2>P\max$$

can be ensured, and further, the apparatus can be miniaturized in comparison with the embodiment shown in FIG. 10.

In this case, the vertical size Hr of the return conveying path 57 becomes larger. However, this does not causes the floor area of the electrophotographic apparatus to be increased even though only the electrophotographic apparatus becomes higher. Thus, since the width W thereof can be decreased, it is effective for miniaturizing the apparatus.

Next, with reference to FIGS. 14 to 18, explanation will be made of an embodiment relating to the second branch means 69.

Figure 14:
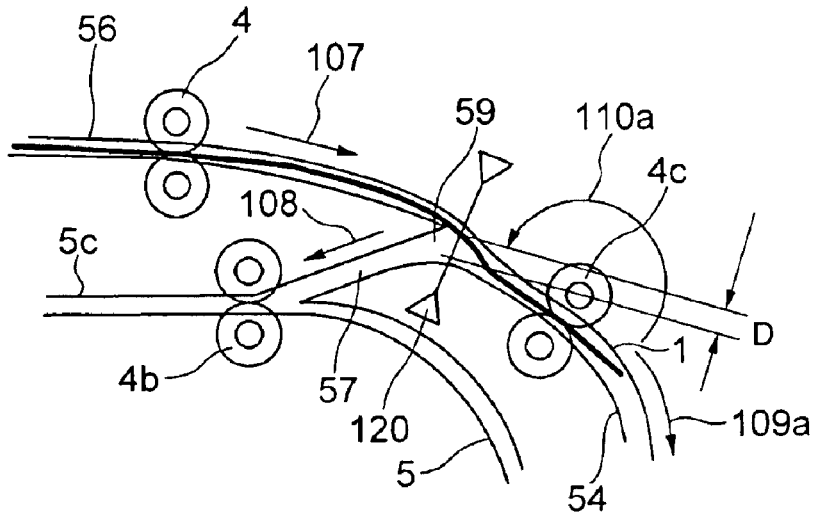
FIG. 14 is a view illustrating an embodiment of the second branch means in the electrophotographic apparatus incorporating the double face printing function according to the present invention.

FIG. 14 is a view illustrating an embodiment of the second branch means 59 in an electrophotographic apparatus incorporating a double face printing function according to the present invention.

A sheet 1 which is conveyed in the bypass conveying path 56 in the direction of the arrow 107, enters into the reversing conveying path 54, upstream of the second branch means 59. The conveying roller 4*c* is rotated clockwise 110*a* so as to feed the sheet 1 in the reversing conveying path 54 in the direction of the arrow 109*a*.

A sheet detecting means 120 is a light transmission type detecting means composed of, for example, a light emitting element and a light receiving element, for detecting the presence of the sheet in the conveying path. When the sheet detecting means 56 detects transmission of light and blocking of light, the timing of passing of the leading end or the trailing end of the sheet 1 which is conveyed in the conveying path can be detected.

Figure 15:
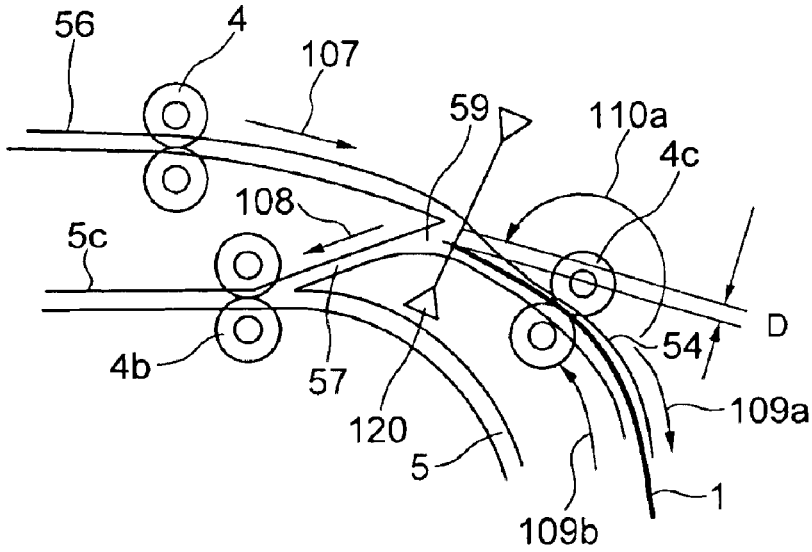
FIG. 15 is a view illustrating a condition at a moment at which a sheet detecting means detects a change from blocking of light to transmission of light in the second branch means shown in FIG. 14.

FIG. 15 is a view illustrating a condition at a moment at which the sheet detecting means detects a change from transmission of light into blocking light in the second branch means 59.

The sheet detecting means 120 is shielded from light during conveyance of the sheet 1. When the sheet detecting means 120 detects a change from the blocking of light into the transmission of light, it can be determined that the trailing end of the conveyed sheet has passed by the position of the detecting means, and accordingly, at this time point, after the sheet is conveyed by a predetermined time or a predetermined length after this point, the conveying rollers 4 is stopped.

Figure 16:
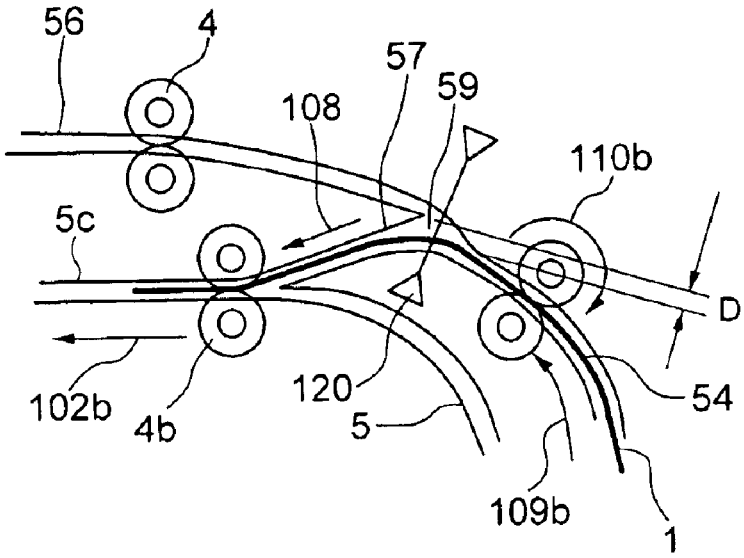
FIG. 16 is a view illustrating a condition in which a sheet is returned from the reversing conveying path onto the main conveying path by way of the return conveying path in the second branch means shown in FIG. 14.

FIG. 16 is a view which shows such a condition that the sheet 1 is returned into the horizontal conveying path 5*c* by way of the return conveying path 57 in the second branch means shown in FIG. 14.

When the conveying roller 4*c* is rotated clockwise 110*b*, the sheet 1 stored in the reversing conveying path 54 is conveyed in the direction 109*b* with the trailing end thereof until then being turned into the leading end.

Since a stepped part D is formed between the bypass conveying path 56 and the reversing conveying path 54, the leading end of the sheet is led in the direction of the arrow 108 within the return conveying path 57.

The sheet 1 which has been conveyed in the return conveying path 57, enters into the horizontal conveying path 5*c*, and accordingly, a toner image is transferred onto the backside surface thereof by the second transfer means 50, and is then fused by the fusing means 51. The sheet 1 is thereafter conveyed in the sheet discharge conveying path 55 in the direction of the arrow 106*a* before it is discharged into the sheet discharge tray 53.

Figure 17:
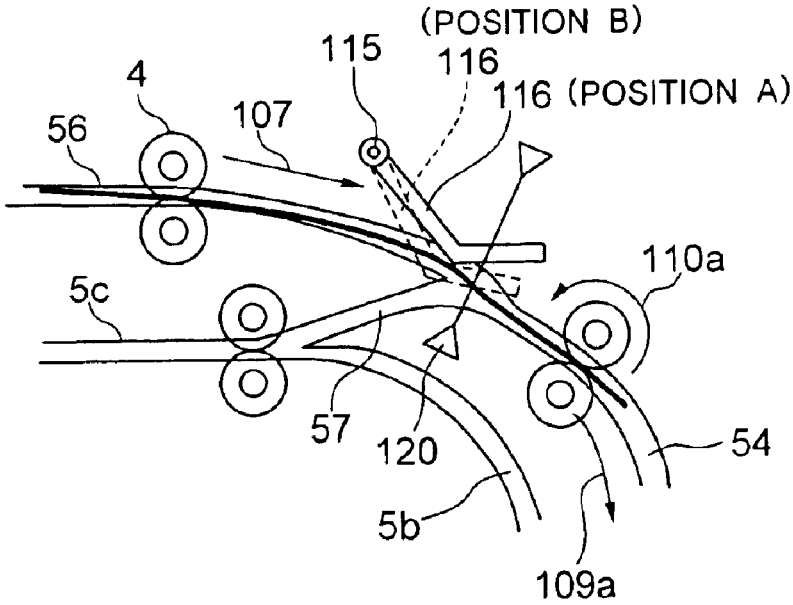
FIG. 17 is a view illustrating an embodiment of the second branch means in the electrophotographic apparatus incorporating the double face printing function according to the present invention.

FIG. 17 is an embodiment of the second branch means in the electrophotographic apparatus incorporating a double face printing function according to the present invention.

In this embodiment, a diversion assist member 116 which is rotatable around a rotating center 115 is incorporated.

When a sheet 1 is conveyed through the bypass conveying path 56, the leading end of the sheet 1 turns the diversion assist member 116 from a gravitational natural drop position B to a position A due to the resiliency of the sheet. When the leading end of the sheet 1 enters into the reversing conveying path 54, the conveying roller 4*c* is rotated in the counterclockwise direction 110*a*, and accordingly, the sheet 1 is conveyed into the reversing conveying path 54.

The trailing end of the sheet 1 has entered into the reversing conveying path 54, the diversion assist member 116 is returned to the natural drop position B under the gravity.

Figure 18:
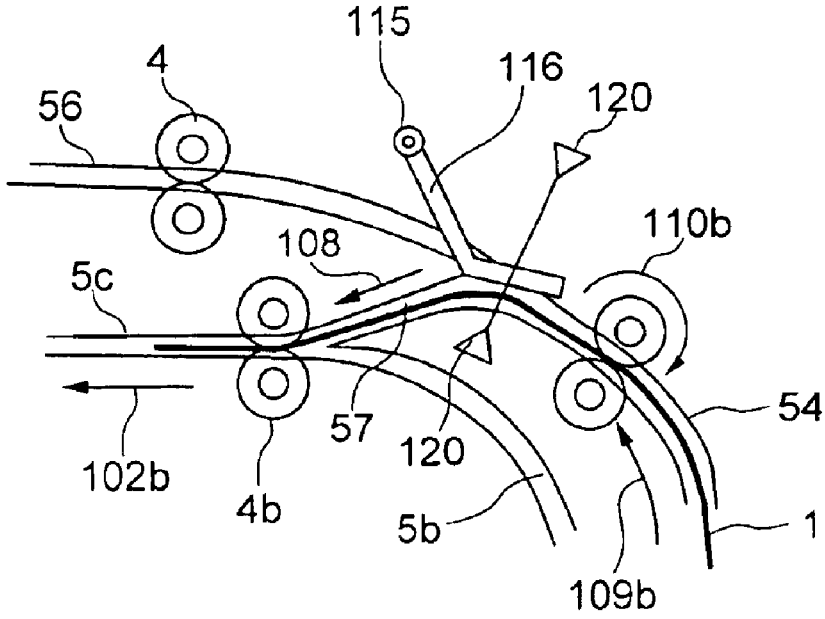
FIG. 18 is a view illustrating a condition in which a sheet is returned from the reversing conveying path onto the main conveying path by way of the return conveying path in the second branch means shown in FIG. 17.

FIG. 18 is a view which shows such a condition that the sheet is returned from the reversing conveying path 54 into the main conveying path 5 by way of the return conveying path 57 in the second branch means shown in FIG. 17.

When the conveying roller 4 is rotated in the clockwise direction 110*b*, the sheet 1 stored in the reversing conveying path 84 is conveyed in the direction of the arrow 109*b* with the trailing end thereof until then being turned into the leading end, and is thereafter fed out from the reversing conveying path 54.

When the leading end of the sheet 1 makes contact with the diversion assist member 116, its advancing direction is turned into a direction toward the return conveying path 57 so that it is conveyed in the direction of the arrow 108.

In this embodiment, the leading end of the sheet 1 is guided into the return conveying path 57 by the diversion assist member 57, the operation of the reversing conveying path can be ensured.

The sheet 1 conveyed through the return conveying path 57 enters into the horizontal conveying path 5*c*, and as shown in FIG. 1, a toner image is transferred onto the backside surface of the sheet 1 by the second transfer means 50 and is fused by the fusing means 51. Thereafter, the sheet is conveyed in the sheet discharge conveying path 55 in the direction of the arrow 106*a*, and is then discharged onto the sheet discharge tray 53.

According to the present invention, since the bypass conveying path for reversing a sheet having a front surface for which printing has been completed, in order to cause the sheet to be subjected to double face printing, is laid substantially in parallel with the main conveying path which is extended from the sheet cassette to the fusing means so that sheets from the sheet cassette located in the bottom part of the casing, are conveyed being separated from one another, one by one, then an image is transferred thereonto by the transfer means, and is fused by the fusing means, a curved guide for turning the direction of the sheet just after it is discharged from the fusing means, by an angle of about 180 deg., is required. However, since each of the bypass conveying path, the reversing conveying path and the return conveying path has a less number of curved portions, thereby it is possible to materialize a recording medium conveying path having a short conveying distance, appropriate for the miniaturization.

Further, since only the reversing conveying path and the main conveying path are provided in two layers in the opening door through which toner or developing means is replaced with new one, the door can be thin, thereby it is possible to miniaturize the apparatus.

Further, since the case upper part is openable, and since the bypass conveying path and the return conveying path are provided in the casing upper part, the disposal of a sheet jam can be facilitated, and even during the replacement of photoconductive drum units, it can be pulled out upward, the maintenance can be simplified.

Thus, there may be provided a small-sized electrophotographic apparatus which incorporates a double face printing function and which can print at a high speed even during double face printing.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. An electrophotographic apparatus comprising a plurality of image forming means each including a photoconductive drum having a photoconductive layer, an exposure means for forming an electrostatic latent image on the photoconductive layer of the photoconductive drum, and a developing means for causing toner to stick to the latent image on the photoconductive drum so as to form a toner image, an endless intermediate transfer belt rotated around and stretched between a drive roller and a driven roller, a second transfer means located above a row of the photoconductive drums, for transferring a toner image from the intermediate transfer belt onto a recording medium, toner images formed on the plurality of photoconductive drums being transferred onto the recording medium through the intermediary of the intermediate transfer belt so as to form a color image thereon, a recording medium supply path composed of a vertical conveying path for conveying a recording medium fed from a sheet cassette in which recording mediums are accommodated, upward outside of the developing means, a curved conveying path, a horizontal conveying path for conveying the recording medium, in a substantially horizontal direction, to the second transfer means, a fusing means located on the horizontal conveying path, downstream of the transfer means, for fusing the transferred toner image on the recording medium, a discharge tray for stacking therein recording mediums for which printing is completed, and which are discharged, a bypass conveying path for conveying a recording medium to be subjected to double face printing, for which printing has been made on one side surface thereof, a first branch means for guiding the recording medium to be subjected to double face printing from the conveying path for the discharge tray, onto the bypass conveying path, a reversing conveying path for reversing the recording medium conveyed on the bypass conveying path during double face printing, a second branching means for guiding the recording medium reversed in the reversing conveying path from the bypass conveying path onto the horizontal conveying path during double face printing, and a return conveying path for conveying the recording medium which has passed through the second branch means onto the horizontal conveying path.

2. An electrophotographic apparatus as set forth in claim 1, wherein only the vertical conveying path and the reversing conveying path are laid in substantially parallel with each other in an opening door at the front surface of the electrophotographic apparatus.

3. An electrophotographic apparatus as set forth in claim 1 or 2, wherein conveying rollers for driving a recording medium which is inserted into the reversing conveying path and is then fed out, are provided on the body side of the electrophotographic apparatus so as to define the reversing conveying path as a mere hollow space.

4. An electrophotographic apparatus as set forth in claim 2, wherein the opening door has a mechanism for opening the door along the vertical conveying path.

5. An electrophotographic apparatus as set forth in claim 1 or 2, wherein a casing upper part which is opened along the curved conveying path and the horizontal conveying path is provided.

6. An electrophotographic apparatus as set forth in claim 5, wherein a mechanism for opening the casing upper part along the bypass conveying path is provided.

7. An electrophotographic apparatus as set forth in claim 1 or 2, wherein a manual sheet feed tray is provided on a substantial extension of the return conveying path.

8. An electrophotographic apparatus as set forth in claim 1 or 2, wherein the following relationships are satisfied:

$$L1 > (2 \times P\max + \mathrm{Gap})$$

$$L2 > P\max$$

where L1 is a length from the looping route which comes out from and returns to the second branch means on the bypass path, by way of the second transfer means on the horizontal path, the fusing means, the first branch means and the bypass path, L2 is a length of the reversing conveying path which extends from the second branch means to a position in the vicinity of the sheet cassette, Pmax is a maximum length of a recording medium, and Gap is intervals of recording mediums to be conveyed.

9. An electrophotographic apparatus as set forth in claim 8, wherein the return conveying path from the second branch means is formed in an S-like shape.

10. An electrophotographic apparatus as set forth in claim 1 or 2, wherein the following relationships are satisfied:

$$L1 > (2 \times P\max + \mathrm{Gap})$$

$$L2 > P\max$$

where L1 is a length from the looping route which comes out from and returns to the second branch means on the bypass path, by way of the second transfer means on the horizontal path, the fusing means, the first branch means and the bypass path, L2 is a length of the reversing conveying path which extends from the second branch means to a position in the vicinity of the sheet cassette, Pmax a maximum length of a recording medium, and Gap is intervals of recording mediums to be conveyed.

11. An electrophotographic apparatus as set forth in claim 1 wherein the second branch means incorporate a stepped part for guiding the leading end of a recording medium fed from the reversing conveying path onto the return conveying path.

12. An electrophotographic apparatus as set forth in claim 1, wherein the second branch means incorporates a branch assist member for guiding the leading end of a recording medium fed out from the reversing conveying path onto the return conveying path, which is lifted by the recording medium when the recording medium is fed from the bypass conveying path onto reversing conveying path, but naturally drops under gravity when the recoding medium is fed from the reversing conveying path onto the return conveying path.

13. An electrophotographic apparatus as set forth in claim 11 or 12, wherein there is provided a recording medium detecting means for detecting the presence of a recording medium on the conveying path from the second branch means to the reversing conveying path so as to determine an operation timing of a recording medium driving mechanism associated with the reversing conveying path.

* * * * *